US012196196B2

(12) United States Patent
Ralls

(10) Patent No.: US 12,196,196 B2
(45) Date of Patent: Jan. 14, 2025

(54) PUMPING UNIT ENGINE SPEED OSCILLATION DETECTION AND MITIGATION

(71) Applicant: Halliburton Energy Services, Inc., Houston, TX (US)

(72) Inventor: Corey Gene Ralls, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 497 days.

(21) Appl. No.: 17/182,516

(22) Filed: Feb. 23, 2021

(65) Prior Publication Data

US 2022/0268270 A1 Aug. 25, 2022

(51) Int. Cl.

| | |
|---|---|
| ***F04B 49/06*** | (2006.01) |
| ***F04B 17/05*** | (2006.01) |
| ***F04B 47/00*** | (2006.01) |
| ***F04B 49/10*** | (2006.01) |

(52) U.S. Cl.

CPC ..... *F04B 49/065* (2013.01); *F04B 17/05* (2013.01); *F04B 47/00* (2013.01); *F04B 49/103* (2013.01); *F04B 2203/0605* (2013.01); *F04B 2207/043* (2013.01)

(58) Field of Classification Search

CPC ..... F04B 17/05; F04B 47/00–145; F04B 49/0606; F04B 49/065; F04B 49/103; F04B 2203/0605; F04B 2207/043

See application file for complete search history.

(56) References Cited

U.S. PATENT DOCUMENTS

| | | | | |
|---|---|---|---|---|
| 6,516,255 | B2 | 2/2003 | Jäger et al. | |
| 6,834,221 | B2 | 12/2004 | Jäger et al. | |
| 7,100,363 | B2 | 9/2006 | Odendall | |
| 7,498,932 | B1 | 3/2009 | Steffen | |
| 8,554,426 | B2 | 10/2013 | Hou | |
| 2018/0209415 | A1* | 7/2018 | Zhang | F04B 17/05 |
| 2018/0216607 | A1* | 8/2018 | Collins | F04B 49/20 |
| 2018/0223831 | A1* | 8/2018 | Zhang | F04B 17/05 |
| 2019/0249652 | A1* | 8/2019 | Stephenson | F04B 15/02 |

FOREIGN PATENT DOCUMENTS

WO WO-2020097053 A1 * 5/2020 ..... E21B 21/08

* cited by examiner

*Primary Examiner* — Alexander B Comley
(74) *Attorney, Agent, or Firm* — DeLizio, Peacock, Lewin & Guerra, LLP

(57) ABSTRACT

An oscillation controller operates on engine speed or RPM data from a pump or pumping unit associated with a wellbore operation. The oscillation controller determines a measure of variability, such as a bandwidth, for the engine speed over a rolling time window and compares the measure of variability to an oscillation bandwidth threshold. The oscillation controller determines that erratic behavior or oscillation is present when the measure of variability exceeds the oscillation bandwidth threshold, and for such instances measures a duration of erratic behavior with a variability timer. If the oscillation controller determines that the erratic behavior has subsided, the variability timer is cleared. The oscillation controller generates at least one warning whenever the variability timer exceeds an oscillation warning threshold. The oscillation controller mitigates erratic behavior by downshifting (or shifting to neutral) at least one gear of the pump or pumping unit if the variability timer exceeds an oscillation mitigation time threshold.

11 Claims, 12 Drawing Sheets

PUMPING UNIT ENGINE SPEED OSCILLATION DETECTION AND MITIGATION

BACKGROUND

The disclosure generally relates to class positive-displacement machines for liquids, pumps for liquids or elastic fluids and subclass positive-displacement machines for liquids, pumps, and more specifically to control of a pump or pumps.

BACKGROUND

During hydraulic fracturing and other wellbore operations, one or more pumps generate fluid flow and maintain or otherwise control pressure to and within the wellbore. Delivery of proppants and other fluids and slurries involve introduction of a controlled volume of fluid or a fluid at a controlled pressure to a drill string or drill pipe, cased wellbore, uncased wellbore, tubing, etc. Hereinafter, "pump" is used to refer to the device which used hydraulic energy to move fluid and "pumping unit" is used to refer to a pump and any motor, engine, transmission, or drive, plus optional support structure, auxiliary systems, controls, power supply, etc. Any instance of "pump" used as an adjective should also be understood to refer to properties generally of a pump or pumping unit. Pump or pumping unit failure can compromise wellbore operations, drill site safety, wellbore viability, etc. Pumping unit engine speed variation decreases pump efficiency and can cause pumping unit wear, decrease pumping unit lifetime, and damage attached or included equipment and transmission(s), power trains or drives.

Most mechanical pumps and pumping units include at least one valve or gear, where fluid (including gas, liquid, and slurry) is pumped or pushed via mechanical force or pressure differential created by mechanical force. When a pumping unit is overloaded or underloaded, or incorrectly loaded for its current gear, stuttering or other erratic engine speed variation can occur. Stuttering or sputtering can manifest as engine speed or rotation per minute (RPM) oscillation or uneven inlet draw or outlet flow. Stuttering, sputtering, and erratic engine speed or RPM variation decrease pumping unit efficiency, and can damage pumping unit parts due to uneven mechanical forces and stress—which can cause pumping unit parts to grind against one another or fail. Erratic engine speed or RPM is also a sign of pumping unit or engine failure in addition to or instead of a sign of mis-gearing or misloading. In these cases, the pumping unit maintenance or replacement involves removing the pumping unit for operation or bringing it offline. Erratic behavior in one or more pumping unit, whether expressed as variation in speed, output, or input, can also damage associated equipment—e.g., cause damage due to insufficient or erratic flow, cause vibrational damage, cause damage due to pressure instability—including transmission and drive train equipment.

BRIEF DESCRIPTION OF THE DRAWINGS

Aspects of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. For instance, this disclosure refers to hydraulic fracturing in illustrative examples. Aspects of this disclosure can be also applied to other wellbore operations. In other instances, well-known instruction instances, protocols, structures, and techniques have not been shown in detail in order not to obfuscate the description.

Overview

Erratic or oscillatory pumping unit engine speed is detected in pumping unit engine speed or RPM, where a variance in RPM is measured over time for a backward-looking rolling window. Abnormal or erratic pumping unit behavior is thereby detected in RPM or engine speed when oscillation or erratic behavior generates variance greater than a variance threshold. Engine speed associated with mechanical pumps, such as rotary pumps, piston pumps, diaphragm pumps, screw pumps, centrifugal pumps, etc., is often measured in RPM, but can be measured using any other appropriate engine speed metric. Hereinafter, engine speed refers also or alternatively to RPM and RPM can be substituted by any other appropriate engine speed measure. Oscillation or erratic behavior not associated with a gear shift or pumping unit change triggers an operator warning and the start of a variability timer when such erratic behavior lasts longer than a first time-threshold. The variability timer counts as long as the erratic behavior is detected. If the oscillation or erratic behavior continues, such that the variability timer exceeds a second time threshold, a pumping unit or transmission gear is downshifted and the variability timer cleared. A pumping unit gear or an engine gear is any gear associated with the engine, pump, or pumping unit including a transmission gear of a pumping unit or a transmission gear of the engine of a pumping unit. If the pumping unit is already in a lowest gear, the pumping unit is shifted to neutral. If the oscillation or erratic behavior abates before the second time threshold, the operator warning and variability timer are cleared. Downshifting of pumping unit gear can mitigate oscillatory behavior caused by overloading. If one downshift fails to mitigate oscillatory or erratic behavior, multiple or sequential downshifting of the pumping unit gear can mitigate oscillatory or erratic behavior. For pumping units which experience erratic behavior even in lowest gear, shifting to neutral removes faulty pumping units or engines from the fluid flow path and transmission or drive load.

Example Illustrations

Figure 1:
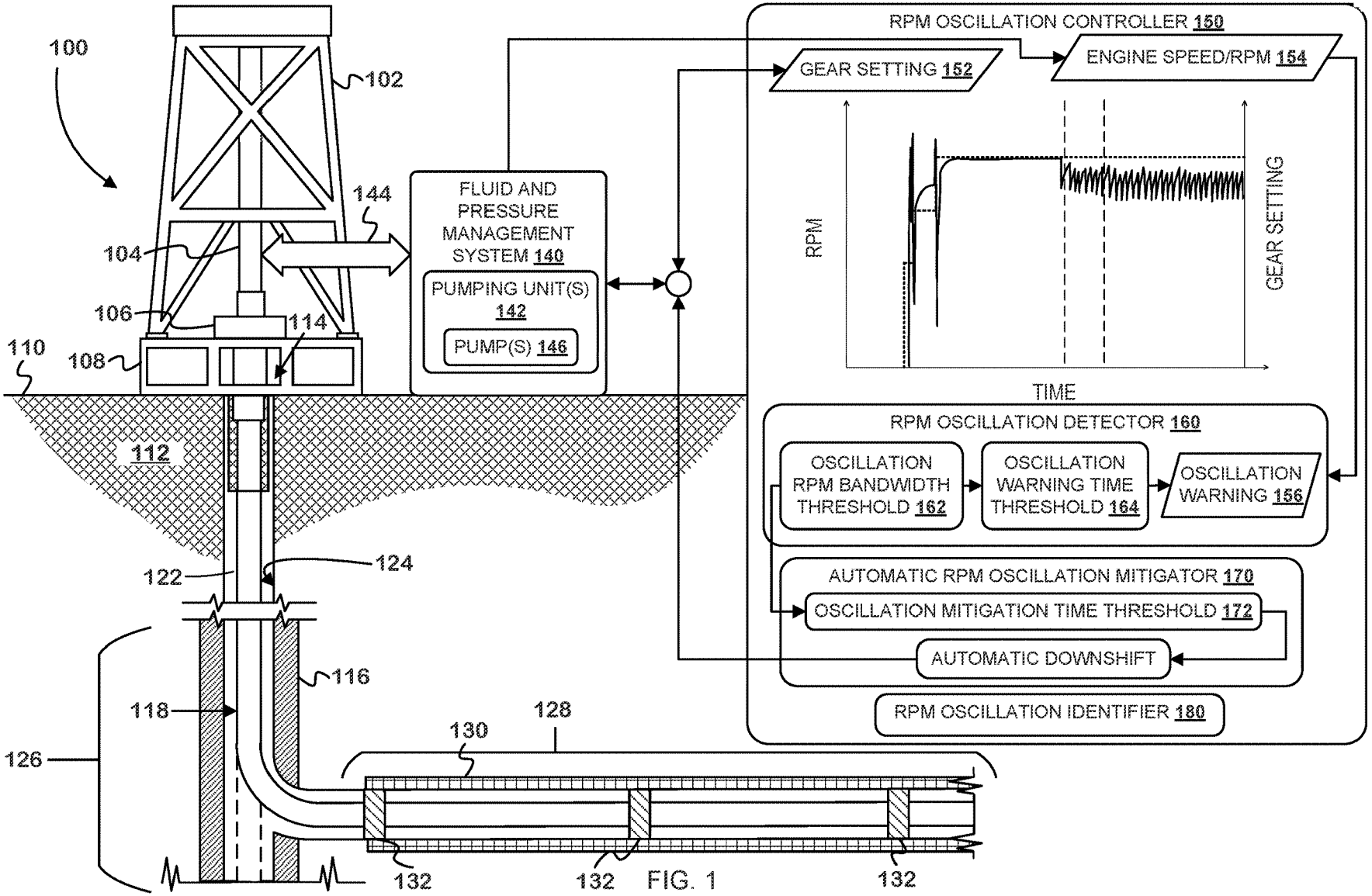
FIG. 1 illustrates an example system for pumping unit engine speed oscillation detection and mitigation.

FIG. 1 illustrates an example system for pumping unit engine speed oscillation detection and mitigation. The system 100 includes a wellbore 114, configured for drilling, hydraulic fracturing ("fracking"), or other wellbore operation involving the use of one or more engines or pumping units. The system 100 includes a drilling rig 102 or other support, a kelly 104, and a rotary table 106 on a drilling platform 108. The kelly 104 and rotary table 106 can be replaced with other apparatus, such as wireline or coiled tubing feeding apparatus, for various wellbore operations. The drilling or wellbore operation platform 108 is shown as located at the surface 110 of a geological or subsurface formation 112, but can also be located underwater, i.e., subsea, on the ocean floor or at or above the waterline and connected to a subsea wellbore. A drill string 118 is lowered into the wellbore 114 from the drilling rig 102. For some wellbore operations, the drill string 118 can be wireline, slickline, a tubular—including coiled tubing, production tubing, casing, etc.—a mandrel, sleeve setter, etc. including tools for fracking, cementing, casing, measurement while drilling (MWD), logging while drilling (LWD). Drilling fluid, drilling mud, fracturing fluid, proppant, etc. pumped down the interior of the drill string 118 or other tubular exits the wellbore 114 through an annulus 122 between the drill string 118 or other tubular and walls or sides 124 of the wellbore 114. Drilling or other fluid can circulate through the annulus 122 to remove cuttings or other drilling debris and to provide pressure support to the walls or sides 124 of the wellbore 114. Drilling fluid or drilling mud can be used to maintain wellbore pressure above the pore pressure and below the fracture gradient in order to prevent wellbore blowout or damage to the subsurface formation 112. Optionally, during wellbore operations including fracking, stimulation, etc., fluids pumped down the drill string 118 or other tubular are discharged into the formation 112.

The wellbore 114 is depicted as containing a vertical portion 126 and a horizontal or lateral portion 128. The vertical portion 126 of the wellbore 114 is shown as surrounded by a casing 116, which can be metal or cement separating the wellbore 114 from the formation 112. The lateral portion 128 of the wellbore 114 is shown as surrounded by a perforated casing 130. Multiple fracture stage separators 132 are depicted in the lateral portion 128 of the wellbore 114, as would be used during a fracking operation. The fracture stage separators 132 can be swellable packers, sleeves, drillable packers, cementable sleeves, or any other type of separators suitable for hydraulic fracturing. The configuration of the wellbore 114 depends on the wellbore operation performed, the field, and the type of well and the configuration depicted in FIG. 1 is provided for example only and is not limiting.

The wellbore 114 is fluidically connected with a fluid and pressure management system 140, which includes one or more pumps 146, which can be components of one or more pumping units 142. The fluid and pressure management system 140 provides fluid flow and hydraulic pressure to and from the drill string 118 or other tubular (such as production casing) and to the annulus 122. The fluid and pressure management system 140 can be configured to support drilling operations, fracking operations, stimulation operations, etc. The fluid and pressure management system 140 is fluidically connected to one or more of the wellbore 114, the drill string 118, the annulus 122, and other tubulars. The fluid and pressure management system 140 optionally includes a fluid source (such as a tank, pressurized tank, or mud pit), a fluid inlet, a fluid outlet, a fluid discharge (such as a holding tank, mud pit, or fluid recirculation system), a choke, a manifold, a transmission, a drive train, one or more valves (including one or more pressure relief valves), an emergency pressure relief system, multiple fluid pathways, the one or more pumping units 142, and the one or more pumps 146. The fluid and pressure management system can be located at the surface 110, on the drill rig 102, or distributed at one or more locations including at the surface 110, on the drill rig 102, and within the wellbore 114.

The pumping unit 142, which provides at least fluid or pressure to the wellbore 114, is controlled by an RPM oscillation controller 150. RPM oscillation, which is a common mode of pump engine speed dysfunction, is used to represent multiple detectable types of engine speed dysfunction. The RPM oscillation controller 150 may be part of the fluid and pressure management system 140, part of a controller or program which controls the fluid and pressure management system 140, or part of a larger controller that controls the wellbore operation. The RPM oscillation controller 150 operates on information transmitted by or communicated from the pumping unit 142. The pumping unit 142 operates at one or various gears (e.g., neutral, first, second, third, etc.) represented by a gear value or gear setting 152, including neutral. The gear setting 152 can be shifted or changed by the RPM oscillation controller 150. The gear setting 152 may be controlled by the RPM oscillation controller 150—or may be controlled by the fluid and pressure management system 140 which may receive gear setting 152 input from multiple control systems or operators. The pumping unit 142 outputs at least one value of RPM or engine speed 154 as a function of time. The pumping unit 142 can output the values RPM or engine speed 154, where RPM is engine speed for a pumping unit with a rotary mechanism. If the pumping unit 142 does not include a rotary pump or engine speed is not measured in RPM, engine speed can be output in another unit of measure, such as cycles per minute, fluid volume, wattage, etc. Engine speed 154 is used hereinafter to refer to any measure of pump, pumping unit, or engine speed or function, including RPM. The pumping unit 142 can optionally store the values of engine speed 154 as a function of time, or the values of engine speed 154 can be stored at the RPM oscillation controller 150.

The RPM oscillation controller 150 includes an RPM oscillation detector 160 and an automatic RPM oscillation mitigator 170. The RPM oscillation detector 160 can detect other types of variable or erratic dysfunction in engine speed 154, including variability which may or may not display periodicity or a characteristic frequency. The RPM oscillation detector 160 determines a bandwidth or other measure of variability (such as a standard deviation) based on the values of engine speed 154 over a first time-window. The RPM oscillation detector 160 then measures the duration of the oscillation or erratic engine speed, by starting a variability timer when the engine speed bandwidth or variability measure exceeds the oscillation RPM bandwidth threshold 162 and tolling the timer for as long as bandwidth or other measure of variability exceeds the oscillation RPM bandwidth threshold 162. Hereinafter, use of the verb "exceeds" and its other grammatical variants shall be understood to include, optionally, cases where a first value is greater than or equal to a threshold or limit such as consistent with "meets and exceeds." The RPM oscillation detector 160 issues an oscillation warning 166 if the variability timer reaches an oscillation warning time threshold 164, which is a first time-threshold. If, before the oscillation warning time threshold 164 is reached, the bandwidth or other measure of variability no longer exceeds the oscillation RPM bandwidth threshold 162 because the oscillation or erratic behavior has resolved or was transitory, the variability timer is cleared.

The automatic RPM oscillation mitigator 170 compares the value of the variability timer to an oscillation mitigation time threshold 172, which is a second time threshold. Alternatively, the automatic RPM oscillation mitigator 170 compares the bandwidth or other measure of variability to the oscillation RPM bandwidth threshold 162 and operates a second variability timer. The oscillation mitigation time threshold 172 can be identical to or longer than the oscillation warning time threshold 164. The values of each of the time thresholds can be set or determined independently, or a relationship between the two time-thresholds can be set or determined, such as the oscillation mitigation time threshold 172 is five times as long as the oscillation warning time threshold 164. The automatic RPM oscillation mitigator 170 triggers an automatic downshift if the variability timer exceeds the oscillation mitigation time threshold 172. If the gear setting 152 is already at a lowest gear, e.g., first gear, the pumping unit is shifted to neutral. If, before the oscillation mitigation time threshold 172 is reached, the bandwidth or other measure of variability no longer exceeds the oscillation RPM bandwidth threshold 162 because the oscillation or erratic behavior has resolved or was transitory, the variability timer and oscillation warning are cleared.

The RPM oscillation controller 150 can optionally include an RPM oscillation identifier 180. The RPM oscillation identifier 180 identifies a cause or source of an erratic or oscillatory engine speed behavior. The RPM oscillation identifier 180 collects values of engine speed during instances of erratic or oscillatory behavior and determines a characteristic value of the behavior (i.e., at least one of frequency, periodicity, or phase of the behavior). The RPM oscillation identifier 180 can determine a frequency, period, phase, etc., through the use of a transform, such as a fast Fourier transform (FFT) or any other appropriate method. The RPM oscillation identifier 180 then compares the characteristic value of the behavior to other characteristic values of the wellbore operation in order to determine if the erratic or oscillatory behavior is caused by another piece of equipment, another operation, another flow, etc. of the wellbore operation. For example, if the fluid flow into the pump or pumping unit exhibits a characteristic frequency at 2.2 hertz (Hz) and the engine speed exhibits oscillatory behavior at 2.2 Hz, the RPM oscillation identifier 180 can conclude that the pumping unit behavior is caused by the fluid flow behavior or that the fluid flow behavior and the pumping unit behavior have the same cause.

The RPM oscillation identifier 180 can also determine the source of oscillation based on vibrational or positional sensors. If one or more component of the wellbore operation exhibits vibrations with a similar characteristic value similar to that of the engine speed erratic or oscillatory behavior or if one or more component experiences vibration or oscillation synchronously with those experienced by the engine speed, that one or more component can be identified as causing the erratic or oscillatory engine speed behavior. Alternatively, the erratic behavior of the one or more wellbore component and the one or more pumping units can share a cause—such as an additional or unmonitored component of the wellbore operation.

Figure 2A:
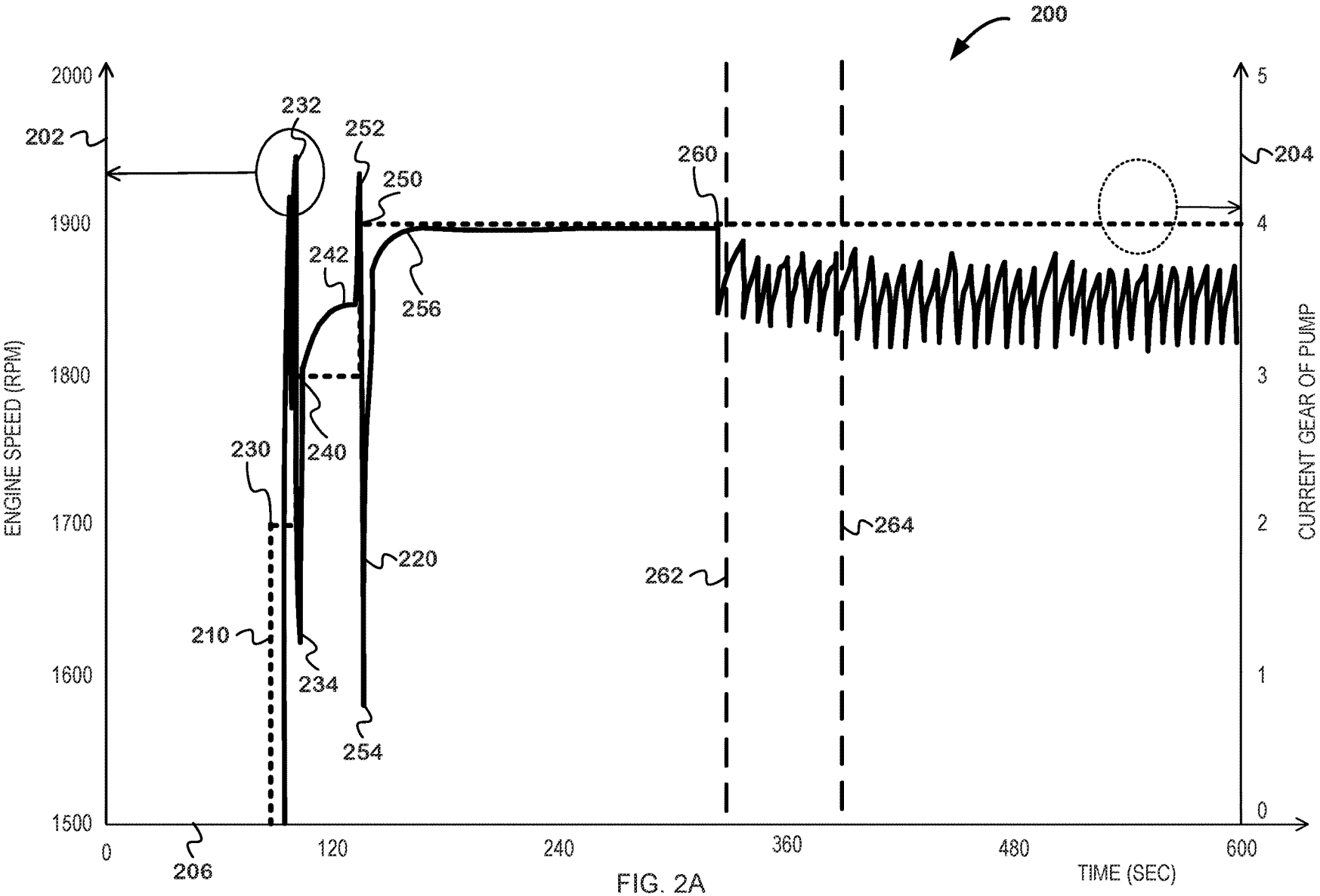
FIGS. 2A and 2B depict example graphs of engine speed and gear as a function of time for engine speed oscillation detection.
Figure 2B:
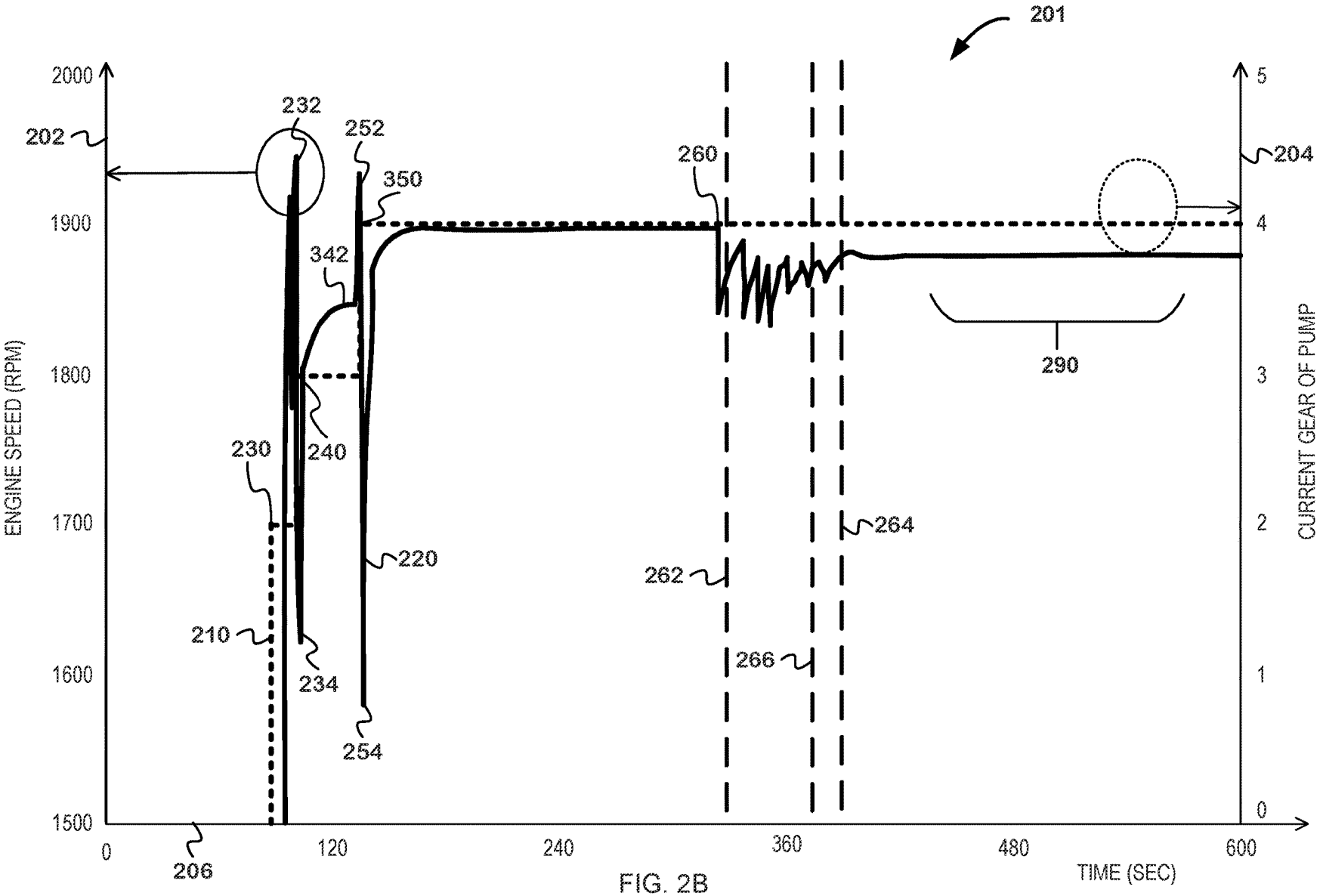

FIGS. 2A and 2B depict example graphs of engine speed and gear as a function of time for engine speed oscillation detection. In FIG. 2A, a graph 200 depicts engine speed in units of RPM (along y-axis 202) and pumping unit gear value (along secondary y-axis 204) as a function of time in seconds (sec) (along x-axis 206). A dashed line 210 corresponds to the current gear setting of the pumping unit over time, while a solid line 220 corresponds to the engine speed measured in RPM of the same pumping unit over time. The dashed line 210 is connected to the secondary y-axis 204 by a dashed circle and arrow, while the solid line 220 is connected to the y-axis 202 by a solid circle and arrow. This is used, in the graph 200 and subsequent graphs, to clarify the y-axis against which each line is graphed. The gear setting or value of the pumping unit corresponds to an integer value or neutral, where a neutral gear can correspond to a gear of zero (0) in a numeric scale, to a gear value of neutral (i.e., a non-integer gear value), or to an unrecorded gear value or absence of a gear value. Optionally, an idling pumping unit and a pump or pumping unit which is off can be distinguished through gear value recordation, where a gear setting or value of neutral for a running pumping unit corresponds to a different value that a gear setting or value for a non-running pumping unit. For a pumping unit which can also operate in reverse the gear setting or value of a reverse or inverse gear or gear value can be expressed as a negative integer.

The dashed line 210 corresponding to the current gear settings illustrates three gear changes, at points 230, 240, and 250. At the point 230 the pumping unit gear changes from neutral or off to second gear (i.e., gear value two (2)). At the point 240, the pumping unit gear changes from second great to third gear (i.e., gear value goes from two (2) to three (3)). At the point 250, the pumping unit gear changes from third gear to fourth gear (i.e., gear value goes from three (3) to four (4)).

The solid line 220 corresponding to engine speed in RPM displays behavioral changes in response to gear changes near the points 230, 240, and 250. The engine speed before the point 230 is not shown on the graph—which can correspond to an idling pumping unit (i.e., a pumping unit in neutral gear) or a non-running pumping unit (i.e., a pumping unit that is turned off). The engine speed responds to the pumping unit gear change at the point 230 by ramping up from a lower speed (e.g., zero for a non-running pumping unit or a lower non-zero RPM for an idling pumping unit) to a local maximum 232 at approximately 1950 RPM. The engine speed then falls to a local minimum 234 at approximately 1625. The engine speed does not reach an equilibrium between the time when the gear shift occurs at the point 230 and the time when a second gear shift occurs at the point 240. The engine speed responds to the pumping unit gear change at the point 240 by gradually increasing from 1800 RPM to 1850 RPM along curve 242. The engine speed then experiences a second local maximum 252 at approximately 1930 RPM followed by a second local minimum 254 at approximately 1575 RPM in response to the gear shift which occurs at the point 250. The engine speed then reaches an equilibrium at a point 256 at approximately 1900 RPM between which lasts until a point 260. The engine speed oscillations, variations, drift, etc. which occur following gear shifts or changes are expected and part of normal pump, pumping unit and engine operation. By using a rolling time window to calculate a measure of variability, or by explicitly excluding erratic behavior caused by gear shifts, these expected oscillations and variations can be ignored by the RPM oscillation detector 160 and the automatic RPM oscillation mitigator 170.

At the point 260, which does not correspond to a gear shift, the engine speed in RPM begins to oscillate. Sawtooth-like oscillation is shown in this example, but other oscillatory behavior can occur—sinusoidal, square wave, variably periodic, etc. Other erratic behavior can also occur, such as monotonically increasing or decreasing RPM, higher variance RPM behavior (i.e., noise), etc. At time 262, the RPM oscillation detector 160 determines that RPM oscillation or other erratic behavior exists based on a measure of engine speed variability. Engine speed variability can be calculated based on a bandwidth, as shown in Equation 1, below:

$$\text{BANDWIDTH}=\text{MAXIMUM(RPM)}-\text{MINIMUM (RPM)} \tag{1}$$

where bandwidth is equal to the difference between a maximum RPM or engine speed and a minimum RPM or engine speed. Engine speed variability can be instead calculated using any other acceptable measure of variability. Measures of variability include variance (such as shown in Equation 2 below), standard deviation (such as shown in Equation 3 below), etc.:

$$\text{Var}(RPM) = \frac{1}{n^2}\sum_i\sum_{j>i}(x_i - x_j)^2 \tag{2}$$

$$\sigma(RPM) = \sqrt{\frac{\sum(x_i-\mu)^2}{N}} \tag{3}$$

where n is the number of elements in the set, $\sigma$ is the population standard deviation, N is the size of the population, $x_i$ is the value of member i of the population and $\mu$ is the population mean. Other equations for bandwidth, variance and standard deviation can be used—these equations are provided as examples and should not be considered limiting.

The RPM oscillation detector 160 determines the selected measure of variability over a rolling time window. The measure of variability is then compared to an oscillation RPM bandwidth threshold. The units and magnitude of the oscillation RPM bandwidth threshold are selected to match those of the measure of variability selected. The rolling time window is a backwards looking range which selects measures of engine speed in a pre-determined window for a sample size N or n upon which the RPM oscillation detector 160 operates to calculate the measure of variability. The rolling time window can be of a predetermined length, for example twenty seconds (20 sec), or can be a percentage or fraction of the oscillation warning time threshold, for example one third as long or 33.3% of the oscillation warning time threshold. The range of values included the rolling time window travels forward in time such that the sample size remains constant.

Optionally, two or more rolling time windows can be selected, where at least one measure of variability is calculated for each time window and where the measures of variability can be different for each of the one or more rolling time windows. For example, a measure of variability (e.g., bandwidth) can be compared to a large oscillation RPM bandwidth threshold (e.g., 200 RPM) over a short rolling time window (e.g., 5 sec) and a second measure of variability (e.g., bandwidth) can be compared to a smaller oscillation RPM bandwidth threshold (e.g., 50 RPM) over a longer rolling time window (e.g., 20 sec). The use of an additional shorter time window with a larger oscillation RPM bandwidth threshold allows detection of larger oscillations or erratic behavior occurrences more quickly, where larger oscillations may be more damaging and benefit from faster mitigation.

When the RPM oscillation detector 160 determines that oscillation or erratic behavior is occurring, a timer—hereinafter called a "variability timer"—is started. The variability timer counts or tolls as long as the RPM oscillation detector 160 determines that the measure of variability exceeds the oscillation RPM bandwidth threshold. For example, in FIG. 2A the RPM oscillation detector 160 starts the variability timer at the time 262 when the bandwidth (as calculated using Eq. 1 above) exceeds an example oscillation RPM bandwidth threshold of 50 RPM. A lag or time offset between the beginning of the RPM oscillation at the point 260 and the start of the variability timer can arise due to calculation time and selections of data values upon which the measure of variability is calculated. For example, a bandwidth may be calculated for every data value of engine speed or may be calculated at predetermined time intervals (such as once a second). The rolling window upon which the measure of variability is calculated may also not include current or simultaneous data, which will depend on system requirements. The bandwidth calculation which occurs at time t=240 sec may include data values for times between t=219 and t=239 sec, for example, as the data collected at time t=240 sec may not be instantaneously available.

The RPM oscillation detector 160 can optionally detect that the pumping unit gear has been changed—where such data can be transmitted by the pumping unit itself or by one or more controllers of the pumping unit. If the RPM oscillation detector 160 detects that the pumping unit gear has been shifted, the RPM oscillation detector 160 can optionally create a time block or prevent the variability timer from starting during a lookback window or other predetermined gear change variability time. For example, the RPM oscillation detector 160 can determine that engine speed variability for one minute (60 sec)—or another predetermined gear change variability time—after a gear change is to be ignored. During the gear change variability time, the variability timer can be blocked from starting—i.e., the variability timer only starts if the gear change variability time is expired. Alternatively, the variability timer can run or toll as long as the measure of variability exceeds the oscillation RPM bandwidth threshold, but the RPM oscillation detector 160 can block or clear any warnings that would otherwise be generated during the gear change variability time. The RPM oscillation detector 160 can then issue any warnings—either warranted by the variability timer value when the gear change variability time ends or accumulated during the gear change variability time—if the measure of variability exceeds the oscillation RPM bandwidth threshold after the gear change variability time has expired.

Alternatively, the RPM oscillation detector 160 can operate on engine speed data without accounting for instances of engine or pumping unit gear change or a gear change variability time. In such cases, the oscillation warning time threshold can be chosen or predetermined such that the oscillation warning time threshold is significantly longer than expected erratic behavior due to a gear change (i.e., the local maximums 232 and 252, the local minimums 234 and 254) so that the RPM oscillation detector does not issue or rarely issues an oscillation warning based on erratic behavior corresponding to a pumping unit gear change. For example, in FIG. 2A the erratic behavior induced by the gear change at the point 250 has subsided by the time of the point 256, where RPM has reached a steady state value of approximately 1900 RPM. If the time between the gear change at the point 250 and when steady state is reached at the point 256 is within the gear change variability time or is shorter than the oscillation warning time threshold, then the RPM oscillation detector 160 does not issue a warning to the wellbore operation operator or controller.

If the variability timer reaches an oscillation warning time threshold, the RPM oscillation detector 160 issues an oscillation warning. For example, in FIG. 2A the oscillation warning time threshold is set to one minute (60 sec) and at a time 264 the variability timer reaches the oscillation warning time threshold. At the time 264, the RPM oscillation detector 160 then issues a warning, such as "RPM oscillation", to an operator or other wellbore operation controller.

In FIG. 2B, a graph 201 depicts an instance of oscillation which is detected at the time 262. The variability timer is started at the time 262, when the RPM oscillation detector 160 determines that the measure of variability exceeds the oscillation RPM bandwidth threshold (e.g., 50 RPM). At time 266 (which is before the time 264), the RPM oscillation detector 160 determines that the measure of variability (e.g., bandwidth) no longer exceeds the oscillation RPM bandwidth threshold and the variability timer is stopped and cleared. In this example, the transient oscillatory behavior resolves without intervention, which can occur if the erratic engine speed is caused by a temporary blockage or debris, or other transitory effect. Because the variability timer does not reach the oscillation warning time threshold (as represented by the time 264), the RPM oscillation detector 160 does not issue a warning to the wellbore operation operator or controller. If a new period of oscillatory or erratic behavior is detected, the RPM oscillation detector 160 restarts the variability timer from zero or begins a new variability timer.

The engine speed after the oscillatory behavior (i.e., in time period 290) is relatively constant at a value of approximately 1875 RPM, which is lower than the steady state engine speed before the time 260. The exact value of engine speed can optionally be monitored; however, pumping unit operation engine speed depends on many features, including power applied, load, flow rate, etc. For example, some high horsepower pumps and pumping units used in fracking can operate successfully at between 1500 and 1950 RPM in any of five (5) gears, but other pump and pumping unit models may have different engine speed ranges, number of gears, etc. Engine speed ranges are determined by pump, pumping unit, and operation type and can drift over time. Therefore, engine speed variability can be a better measure of pumping unit performance than engine speed magnitude or mean.

Figure 3A:
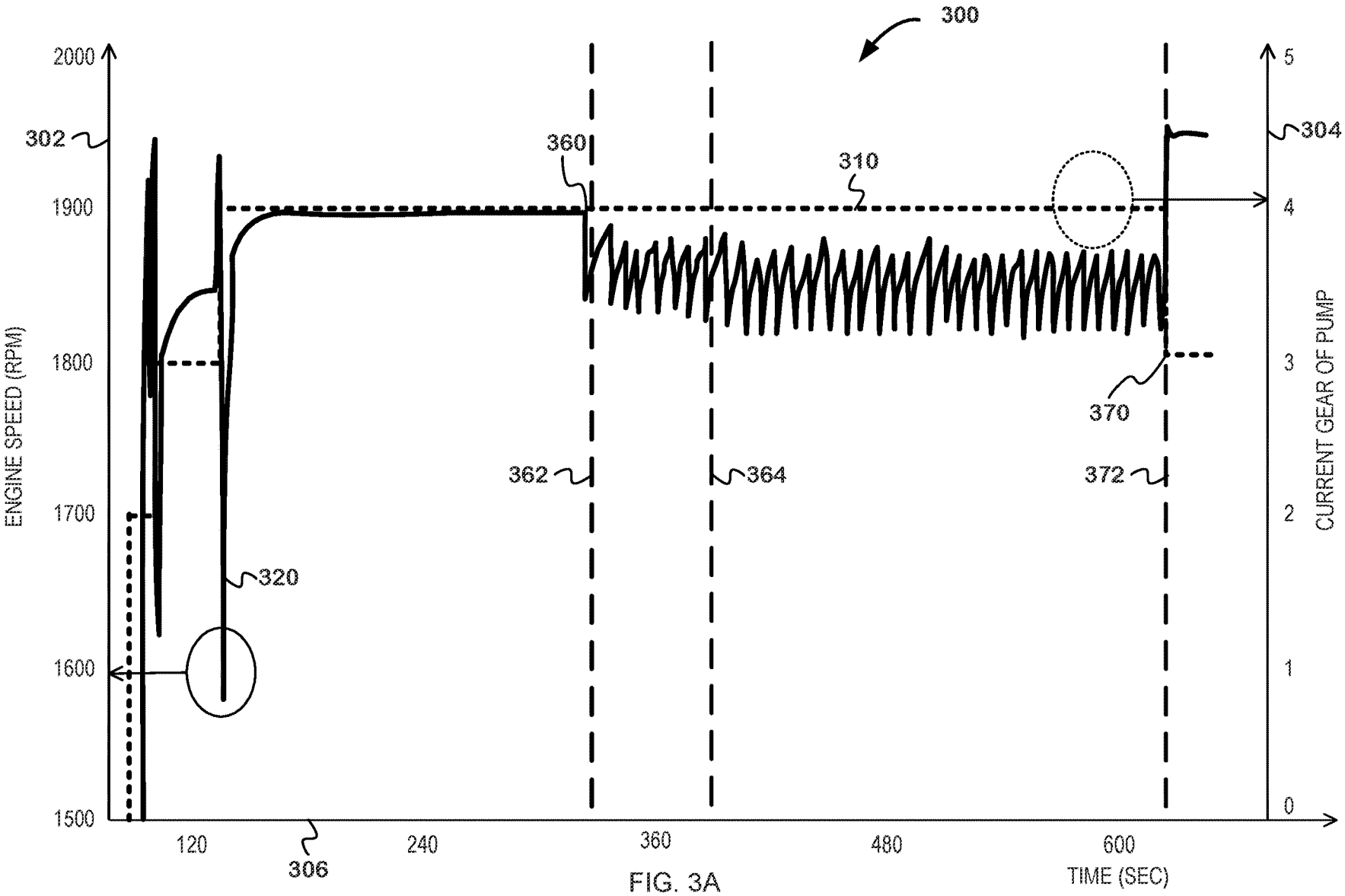
FIGS. 3A and 3B depict example graphs of engine speed and gear as a function of time for engine speed oscillation mitigation.
Figure 3B:
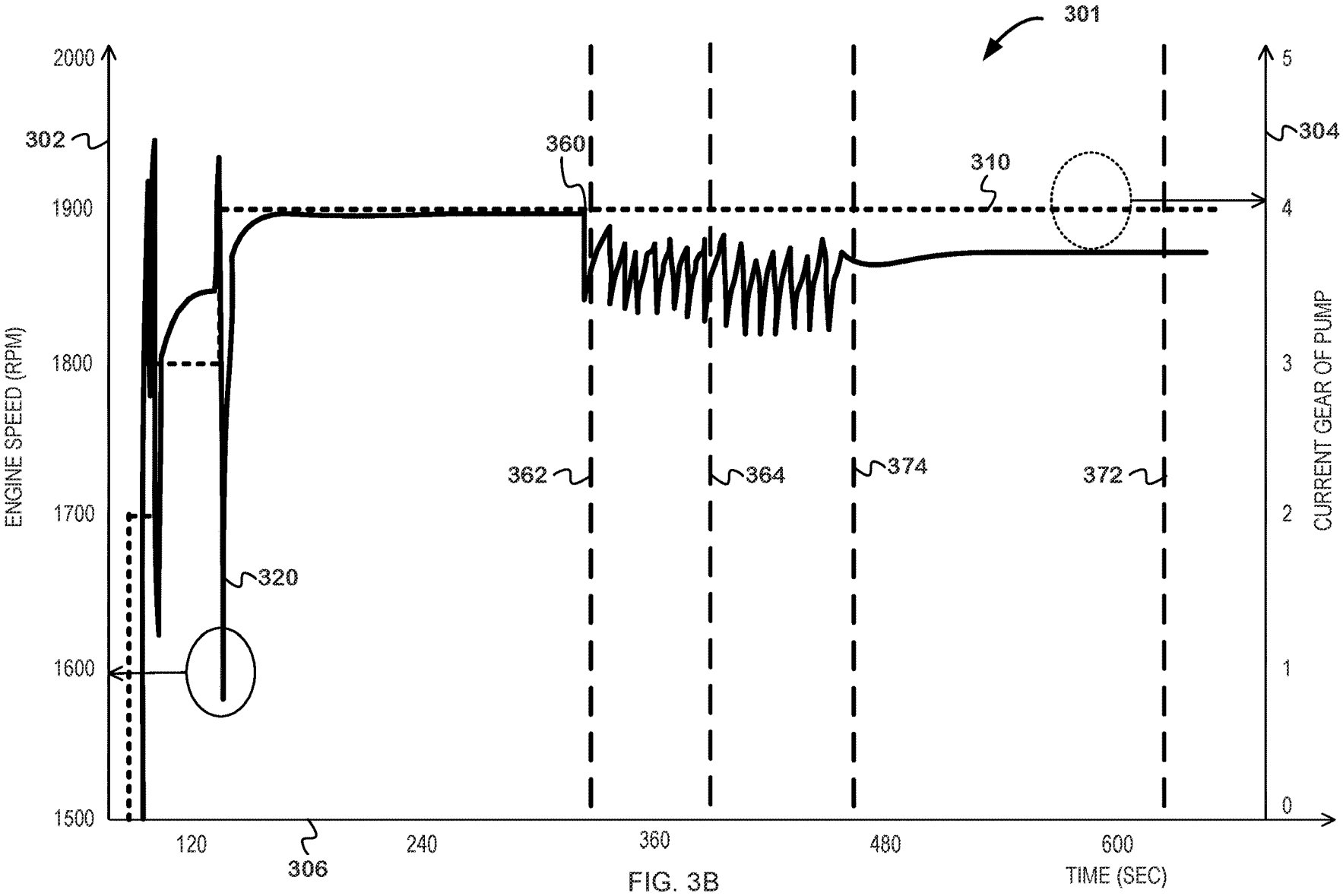

FIGS. 3A and 3B depict example graphs of engine speed and gear as a function of time for engine speed oscillation mitigation. In FIG. 3A, a graph 300 depicts engine speed in RPM along y-axis 302 and pump gear value along secondary y-axis 304 as a function of time (in sec) along x-axis 306. A dashed line 310 corresponds to the gear setting of the pumping unit, while a solid line 320 corresponds to the engine speed in RPM of the same pumping unit.

At the point 360, which does not correspond to a gear shift, the engine speed in RPM begins to oscillate in a sawtooth-like oscillation. At time 362, the RPM oscillation detector 160 determines that RPM oscillation or other erratic behavior exists based on a measure of engine speed variability. At a time 364 the variability timer reaches the oscillation warning time threshold, and the RPM oscillation detector 160 issues an oscillation or variability warning, such as "RPM oscillation", to the operator or other wellbore operation controller.

The RPM oscillation detector 160 can then trigger an automatic RPM oscillation mitigator 170. Alternatively, the automatic RPM oscillation mitigator 170 can be part of the RPM oscillation detector 160, can be triggered by the staring of the variability timer, can operate on the variability timer of the RPM oscillation detector 170, or can initiate a new or second variability timer. The automatic RPM oscillation mitigator 170 compares a variability timer, which for simplicity will hereinafter be referred to as the variability timer of the RPM oscillation detector 160 but which is not limited to this case, against an oscillation mitigation time threshold. The oscillation mitigation time threshold can be a predetermined length, for example five minutes (5 min), or can be a multiple of the oscillation warning time threshold, for example five times as long as the oscillation warning time threshold. The oscillation mitigation time threshold is as long as or longer than the oscillation warning time threshold, except in cases where emergency mitigation is desired and even in these cases a warning is preferentially issued when oscillation is mitigated. If no warning is desired, the oscillation warning time threshold can be set to a long or infinite time or the oscillation warning otherwise disabled.

In FIG. 3A, the example oscillation mitigation time threshold is set to 5 mins. When the variability timer, which starts at the time 362, reaches the time 372 the automatic RPM oscillation mitigator 170 causes a pumping unit or transmission associated with an engine to gear shift. The automatic RPM oscillation mitigator 170 downshifts the pumping unit or engine from fourth gear (gear 4) to third gear (gear 3) at a point 370. The variability timer tolls from the time 362 to the time 372, when the automatic RPM oscillation mitigator 170 clears the variability timer and downshifts the pumping unit. After the gear shift at the point 370, the pumping unit RPM appears to reach a new steady state value at approximately 1950 RPM while in third gear.

In FIG. 3B, in a graph 301 the example oscillation mitigation time threshold is also set to 5 mins (i.e., the same value as shown in FIG. 3A), but the oscillatory behavior resolves itself and the measure of variability falls below the oscillation RPM bandwidth threshold at a time 374, which is before the time 372 when the variability timer would exceed the oscillation mitigation time threshold. In this example, the RPM oscillation detector 160 issues an oscillation or variability warning at the time 364 but the automatic RPM oscillation mitigator 170 (or optionally the RPM oscillation detector 160) clears the warning and the variability timer at the time 374—an no automatic gear downshift is triggered.

Figure 4A:
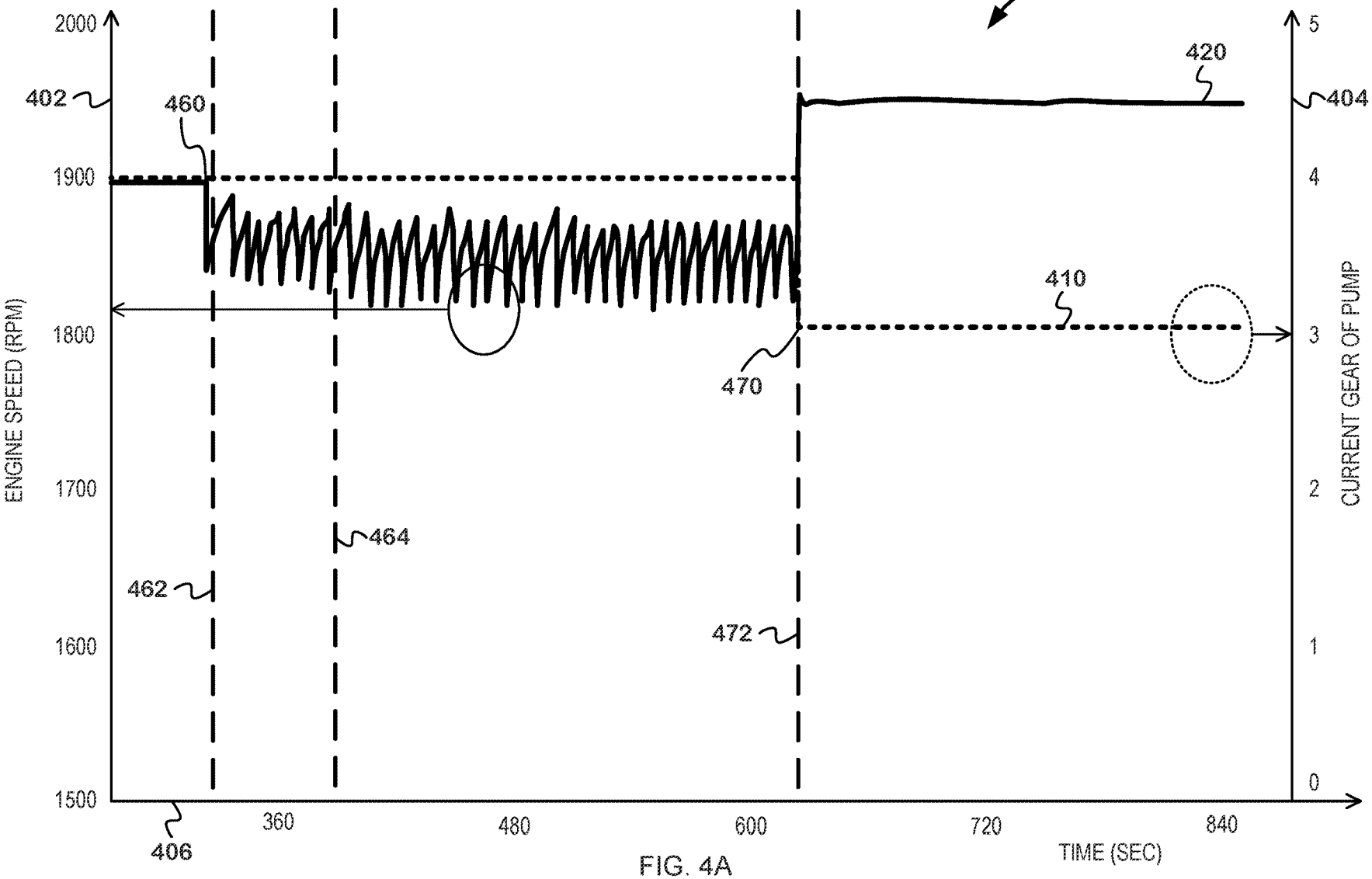
FIGS. 4A-4C depict example graphs of engine speed and gear as a function of time in which engine speed oscillation is mitigated.
Figure 4B:
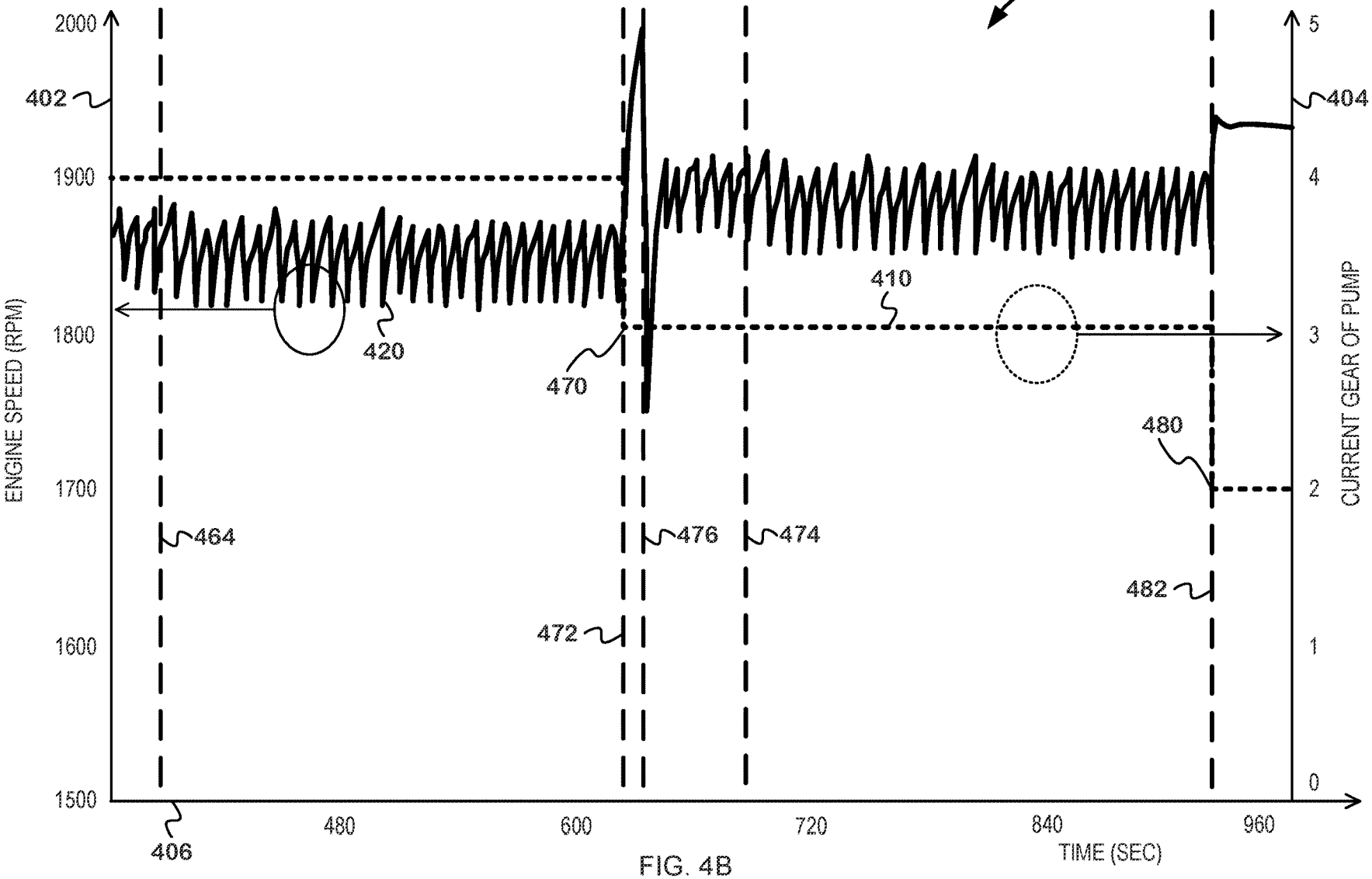
Figure 4C:
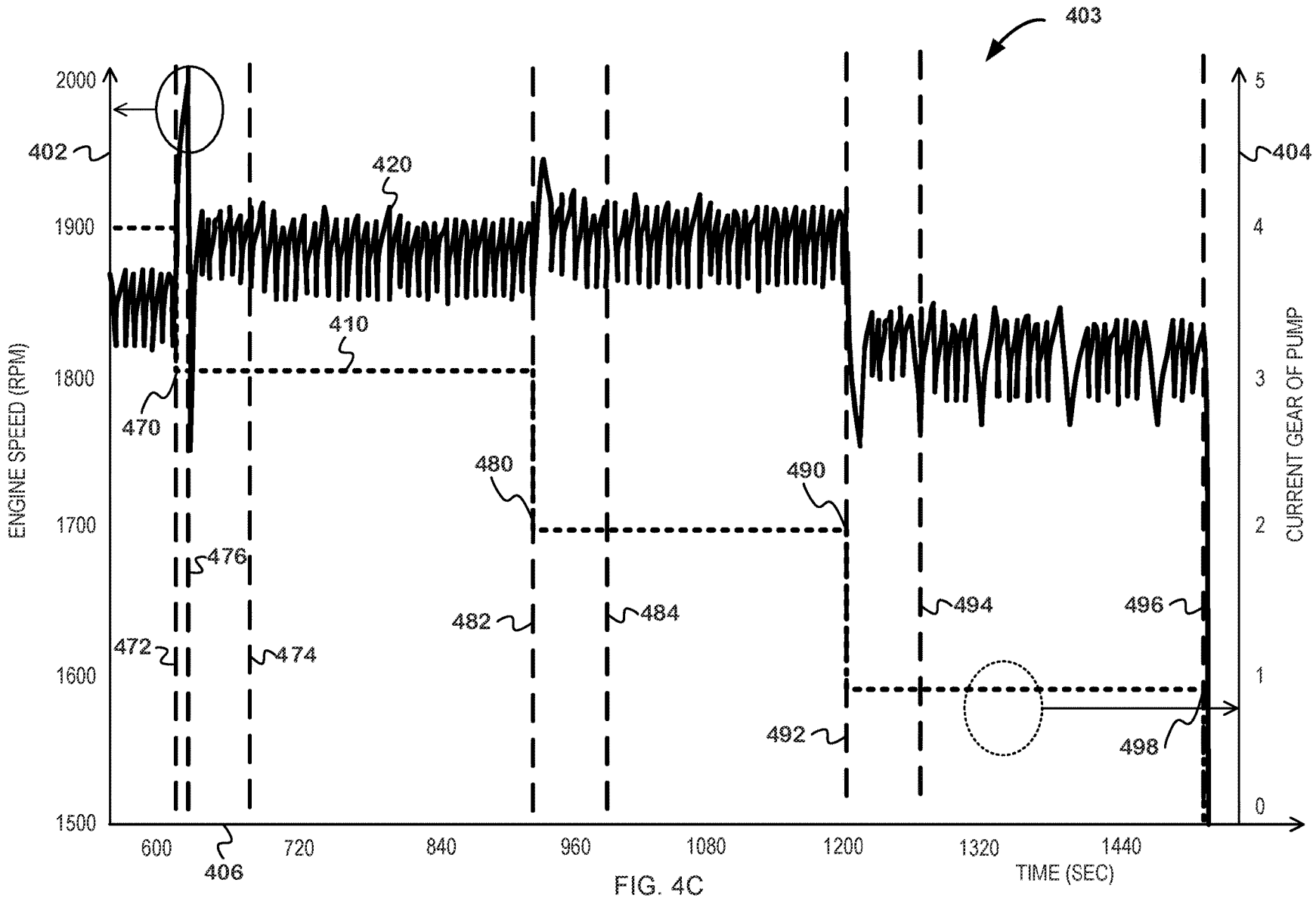

FIGS. 4A, 4B and 4C depict example graphs of engine speed and gear as a function of time in which engine speed oscillation is mitigated. In FIG. 4A, a graph 400 depicts engine speed in RPM along y-axis 402 and pumping unit gear value along secondary y-axis 404 as a function of time (in sec) along x-axis 406. A dashed line 410 corresponds to the gear setting of the pumping unit, while a solid line 420 corresponds to the engine speed in RPM of the same pumping unit. At the point 460, which does not correspond to a gear shift, the engine speed in RPM begins to oscillate in a sawtooth-like oscillation. At time 462, the RPM oscillation detector 160 determines that RPM oscillation or other erratic behavior exists based on a measure of engine speed variability. At a time 464 the variability timer reaches the oscillation warning time threshold, and the RPM oscillation detector 160 issues an oscillation or variability warning, such as "RPM oscillation", to the operator or other wellbore operation controller. At a time 472, the automatic RPM oscillation mitigator 170 triggers a down shift from fourth gear (gear 4) to third gear (gear 3) in response to the variability timer exceeding the oscillation mitigation time threshold. In the example graph shown in FIG. 4A, RPM oscillation is successfully mitigated by the gear shift triggered at a point 470. Following the downshift to third gear, the engine speed displays no oscillation and the measure of variability no longer exceeds the oscillation RPM bandwidth threshold. The RPM oscillation detector 160 does not restart the variability timer or ends the variability timer before the oscillation warning time threshold is reached.

In FIG. 4B, a graph 401 depicts an instance in which a first downshift does not mitigate engine speed oscillation, but a second downshift does mitigate engine speed oscillation. At a point (not depicted in FIG. 4B), the engine speed in RPM begins to oscillate in a sawtooth-like oscillation. At a time (not depicted in FIG. 4B) which may or may not coincide exactly with the beginning of the oscillation, the RPM oscillation detector 160 determines that RPM oscillation or other erratic behavior exists based on a measure of engine speed variability. At the time 464 the variability timer reaches the oscillation warning time threshold, and the RPM oscillation detector 160 issues an oscillation or variability warning, such as "RPM oscillation", to the operator or other wellbore operation controller. At the time 472, the automatic RPM oscillation mitigator 170 triggers a down shift from fourth gear (gear 4) to third gear (gear 3) in response to the variability timer exceeding the oscillation mitigation time threshold. In the example graph shown in FIG. 4B, RPM oscillation is not successfully mitigated by the gear shift triggered at a point 470. The RPM oscillation detector 160 or the automatic RPM oscillation mitigator 170 clears the variability timer when the gear shift at the point 470 is triggered.

Following the gear shift, the RPM oscillation detector 160 can either wait or count out a gear change variability time or can restart the variability timer whenever the measure of variability exceeds the oscillation RPM bandwidth threshold. In the example graph shown in FIG. 4B, the oscillation detector clears the variability timer at the time 472 when the gear is downshifted, and then restarts the variability timer (counting from zero) at the time as soon as a measure of variability is detected which exceeds the oscillation RPM bandwidth threshold. The measure of variability is determined based on data for the rolling time window, which can include the engine speed data corresponding to the previous gear or which can be restarted or reset to include only data corresponding to the current gear. In the example graph shown in FIG. 4B, the rolling window is reset when the gear is downshifted to third gear (gear 3) and the variability timer is restarted when the measure of variability exceeds the oscillation RPM bandwidth threshold at a time 476. At a time 474 the variability timer reaches the oscillation warning time threshold, and the RPM oscillation detector 160 issues an oscillation or variability warning to the operator or other wellbore operation controller. At a time 482, the automatic RPM oscillation mitigator 170 triggers a down shift from third gear (gear 3) to second gear (gear 2) in response to the variability timer exceeding the oscillation mitigation time threshold.

In the example graph shown in FIG. 4B, RPM oscillation is successfully mitigated by the gear shift triggered at a point 480. Following the downshift to second gear, the engine speed displays no oscillation and the measure of variability no longer exceeds the oscillation RPM bandwidth threshold. The RPM oscillation detector 160 does not restart the variability timer or ends the variability timer before the oscillation warning time threshold is reached.

In FIG. 4C, a graph 403 depicts an instance in which multiple downshifts do not mitigate engine speed oscillation, and the pumping unit is subsequently shifted to neutral to mitigate engine speed oscillation. At a point (not depicted in FIG. 4C), the engine speed in RPM begins to oscillate in a sawtooth-like oscillation. When the variability timer reaches the oscillation warning time threshold, the RPM oscillation detector 160 issues an oscillation or variability warning to the operator or other wellbore operation controller. At the time 472, the automatic RPM oscillation mitigator 170 triggers a down shift from fourth gear (gear 4) to third gear (gear 3) in response to the variability timer exceeding the oscillation mitigation time threshold. In the example graph shown in FIG. 4C, RPM oscillation is not successfully mitigated by the gear shift triggered at a point 470. The RPM oscillation detector 160 or the automatic RPM oscillation mitigator 170 clears the variability timer when the gear shift at the point 470 is triggered.

In the example graph shown in FIG. 4C, the oscillation detector clears the variability timer at the time 472 when the gear is downshifted, and then restarts the variability timer (counting from zero) at the time as soon as a measure of variability over the rolling time window exceeds the oscillation RPM bandwidth threshold at the time 476. At the time 474 the variability timer reaches the oscillation warning time threshold, and the RPM oscillation detector 160 issues an oscillation or variability warning to the operator or other wellbore operation controller. At a time 482, the automatic RPM oscillation mitigator 170 triggers a down shift from third gear (gear 3) to second gear (gear 2) at a point 480 in response to the variability timer exceeding the oscillation mitigation time threshold.

The oscillation detector clears the variability timer at the time 482 when the gear is downshifted, and then restarts the variability timer (counting from zero) at the time as soon as a measure of variability over the rolling time window exceeds the oscillation RPM bandwidth threshold. At a time 484 the variability timer reaches the oscillation warning time threshold, and the RPM oscillation detector 160 issues an oscillation or variability warning to the operator or other wellbore operation controller. At a time 492, the automatic RPM oscillation mitigator 170 triggers a down shift from second gear (gear 2) to first gear (gear 1) at a point 490 in response to the variability timer exceeding the oscillation mitigation time threshold.

The oscillation detector clears the variability timer at the time 492 when the gear is downshifted, and then restarts the variability timer (counting from zero) at the time as soon as a measure of variability over the rolling time window exceeds the oscillation RPM bandwidth threshold. At a time 494 the variability timer reaches the oscillation warning time threshold, and the RPM oscillation detector 160 issues an oscillation or variability warning to the operator or other wellbore operation controller. At a time 496, the automatic RPM oscillation mitigator 170 triggers a shift from first gear (gear 1) to neutral (gear 0), since there is no lower gear available, at a point 498 in response to the variability timer exceeding the oscillation mitigation time threshold. A pumping unit in neutral should exhibit no oscillatory behavior as a result of load, flow, power, etc., but may exhibit erratic RPM if the pumping unit itself is faulty. The neutral pumping unit essentially disconnected from the transmission or drive train, and therefore does not cause damage to other associated wellbore equipment. The automatic RPM oscillation mitigator 170 can optionally turn the pumping unit off. The automatic RPM oscillation mitigator 170 issues a warning or alert to the wellbore operation operator or controller when the pumping unit is shifted to neutral or turned off—as a pumping unit that is either in neutral or turned off is offline and may jeopardize wellbore operations or safety and need to be backed up or replaced. In the example shown in FIG. 4C, the wellbore operation operator or controller receives four warnings that oscillation has been detected in the engine speed of the example pumping unit before the pumping unit is automatically shifted to neutral, where such warnings enable the operator or controller to move back up pumping units into place or adjust operations before the pumping unit is brought offline or before pumping unit failure occurs.

Figure 5:
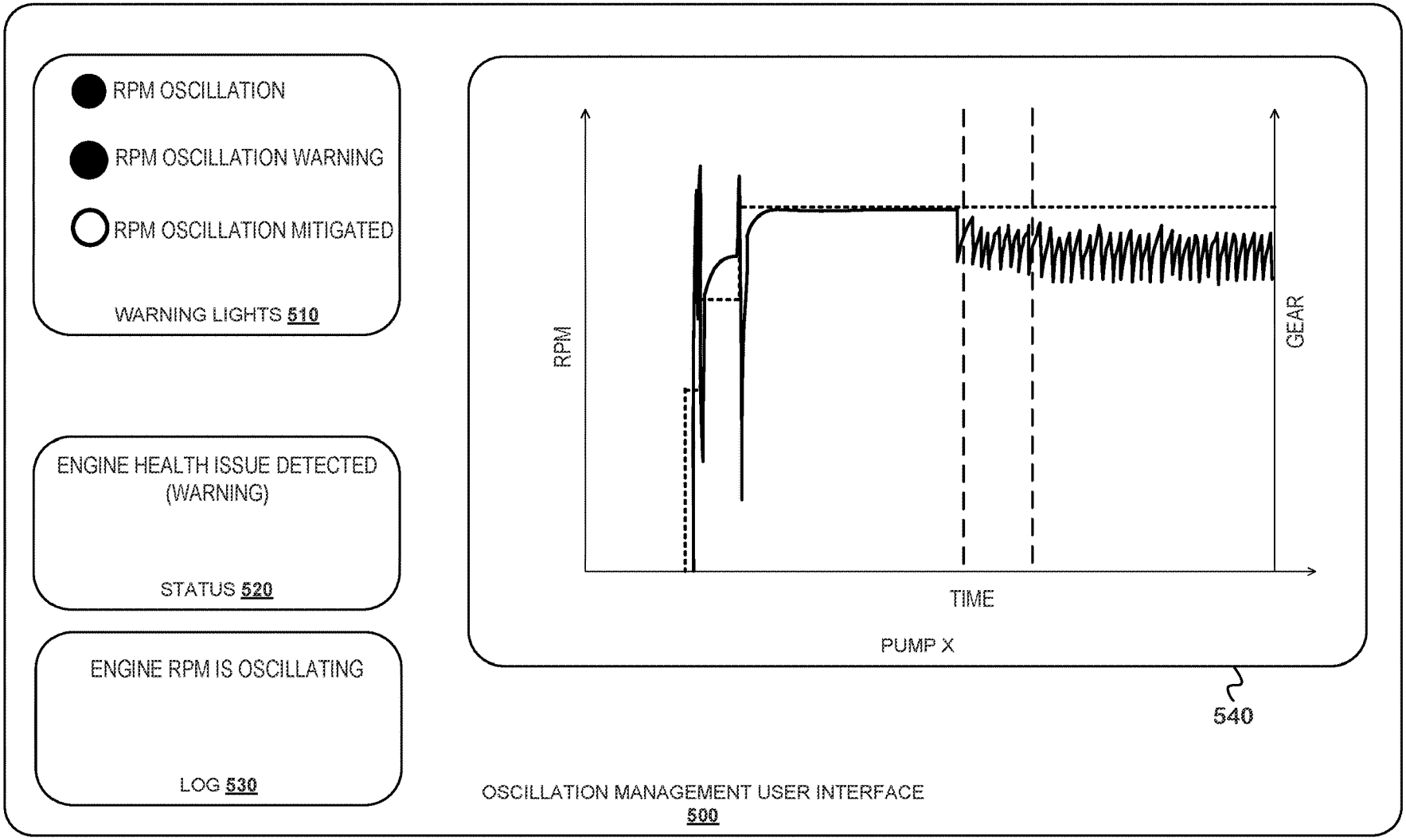
FIG. 5 illustrates an example operator interface for pumping unit engine speed oscillation management.

FIG. 5 illustrates an example oscillation management user interface (UI) for pumping unit engine speed oscillation management. FIG. 5 depicts an example UI as a multiple object window, but embodiments are not so limited. Embodiments of the UI can present information in multiple windows, additional or less information than depicted, and/or with different types of objects (e.g., a breakout graph, log, status, etc.). The UI can present information for additional equipment or be integrated with UIs for additional equipment or operations (e.g., an additional pumping unit, a pump truck, a fracking operation, drilling, etc.).

An oscillation management user interface 500 is depicted as displaying information related to oscillation management in 4 UI objects: a set of warning lights 510, a status indicator 520, a log 530, and a graph 540 of engine speed and gear value versus time for a pumping unit X. Each of these UI objects is displayed according to UI settings that can be applied globally across the objects or settings per object. As examples, information may be displayed continuously, based on an operator selection, on an as-needed basis, or in response to warnings or actions by the RPM oscillation detector 160 or the automatic RPM oscillation mitigator 170. In the example depicted in FIG. 5, an RPM oscillation light is activated because the RPM oscillation detector 160 has determined that the measure of variability exceeds the oscillation RPM bandwidth threshold. An RPM oscillation warning light is also activated because the RPM oscillation detector 160 has determined that the variability timer exceeds the oscillation warning time threshold. The RPM oscillation light and the RPM oscillation warning light can also be combined, such that a light turns orange to indicate RPM oscillation (i.e., when the measure of variability exceeds the oscillation RPM bandwidth threshold) and the same light turns red when variability timer exceeds the oscillation warning threshold. An RPM oscillation mitigated light is optionally activated by the automatic RPM oscillation mitigator 170 when a downshift or other gear shift (e.g., to neutral) is triggered. A pump offline light or pumping unit offline light can further be provided which is activated by the automatic RPM oscillation mitigator 170 if one or more pumping units are shifted to neutral or otherwise brought offline. Any RPM oscillation light, RPM oscillation warning light, RPM oscillation mitigated light, etc. can also or instead by a pop-up warning or notification.

The status indicator 520 displays current status of the engine health for each of the one or more pumping units. In the example display depicted in FIG. 5, the status indicator 520 displays "Engine health issue detected (warning)". However, any appropriate warning or notification text can be used. The status indicator can indicate engine health for each of the one or more pumping units of the wellbore operation or can only indicate engine health for any pumping units operating outside a pre-determined normal operation range. The status indicator can be incorporated into a larger status indicator or display including one or more additional pieces of equipment or operational statues for a wellbore operation.

The log 530 displays or logs engine health or operation characteristics for each of the one or more pumping units of the wellbore operation. The log 530 can include both events or occurrences and the time at which they occur. The log 530 can further include any instances of detected erratic RPM (defined as when the measure of variability exceeds the oscillation RPM bandwidth threshold), any instances of warnings or error messages generated or displayed to the wellbore operation operator or controller, any instance of pumping unit gear shifting—including any downshifting or shifting to neutral initiated by the automatic RPM oscillation mitigator 170. The log 530 can be displayed in full, for a backward-looking or rolling time window, or for a back-looking rolling number of events, or can be saved as a data file. The log 530 can include generation of a data file which includes collected values of pumping unit gear and engine speed over the wellbore operation which can be used to evaluate the wellbore operation or implementation after the operation is complete. The log 530 can optionally record all values of pumping unit gear and engine speed in addition to any instances of warnings or other operations produced by the RPM oscillation detector 160 and the automatic RPM oscillation mitigator 170 while only displaying to the wellbore operator the most important or pertinent events.

The graph 540 can include any graph of values of engine speed and gear over time, such as those examples previously depicted in FIGS. 2A-2B, 3A-3B, and 4A-3C. The graph 540 can be automatically shown or displayed or can be available as a breakout or pop-up option. The graph 540 can display values of engine speed and gear on an x-y plot where values of engine speed and values of gear are displayed with respect to different y-axis. Alternatively, the graph 540 can be displayed as two graphs where the values of engine speed and the values of gear are displayed separately. The graph 540 can display values of engine speed and gear over a rolling time window, of a length which can be pre-determined or operator selected, or can add values of engine speed and gear to the time display as they are acquired during a wellbore operation. The graph 540 can display values of engine speed and gear for one or more pumping units or the graph 540 can instead be a set of graphs where each of the one or more pumping units of the wellbore operation is plotted on a separate graph.

The oscillation management user interface 500 can be displayed at the drilling site, such as at the surface 110 or at the fluid and pressure management system 140 as shown in FIG. 1 or can be displayed to an operator at a remote operation. The distance between the oscillation management user interface 500 and the one or more pumping units is determined in part by the safety requirements of the wellbore operation, including the red or exclusionary zone in which personnel are prohibited. The oscillation management user interface 500 allows pumping unit operation, which could historically be monitored audibly or by physical observation of pump or pumping unit behavior, to be monitored and corrected at a safe distance.

Although the depicted example oscillation management user interface 500 or UI presumes presentation of the oscillation management interface through a graphical user interface, some of the information can instead be presented with a hardware panel. For example, the warning lights can instead or additionally be implemented as physical lights controlled by signals generated based on communications from the underlying software that manages oscillation. Similarly, the software managing oscillation can interact with a communication system to send notifications to operators via electronic mail, text messages, or voice calls. In addition, the software can cause signals to be sent to a separate display (e.g., monitor or light panel) that displays warnings and notifications accordingly.

Figure 6:
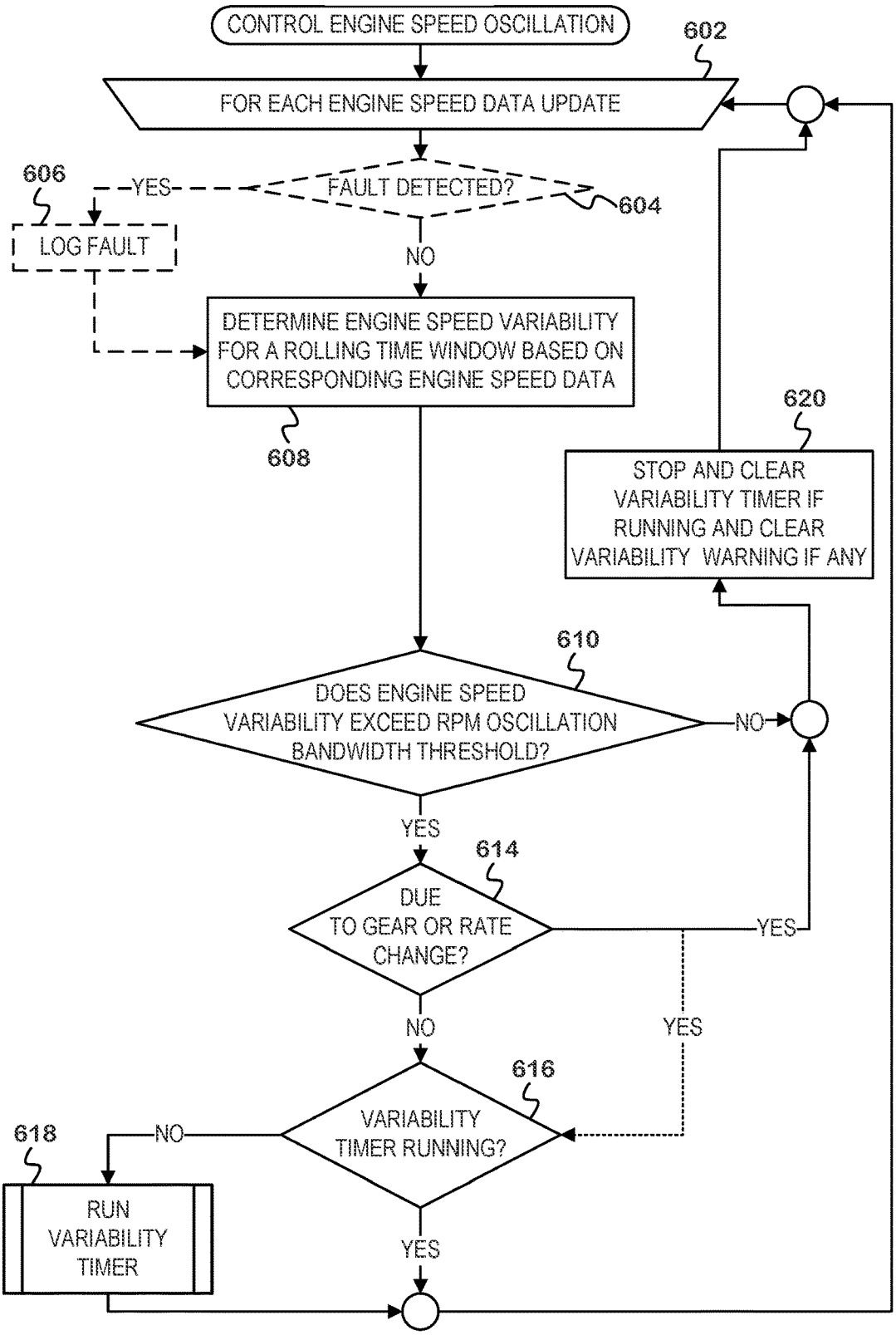
FIG. 6 is a flowchart of example operations for detecting and monitoring pumping unit engine speed oscillation.

FIG. 6 is a flowchart of example operations for detecting and monitoring pumping unit engine speed oscillation. The example operations are described with reference to an RPM oscillation controller 150, an RPM oscillation detector 160, and an automatic RPM oscillation mitigator 170 for consistency with the earlier figure(s). For simplicity, the RPM oscillation detector 160 and the automatic RPM oscillation mitigator 170 are collectively referred to as the RPM oscillation controller 150, where example operations described as performed by the RPM oscillation controller 150 can be performed by either or both of the RPM oscillation detector 160 and the automatic RPM oscillation mitigator 170 or another portion of the RPM oscillation controller 150. The name chosen for the program code is not to be limiting on the claims. Structure and organization of a program can vary due to platform, programmer/architect preferences, programming language, etc. In addition, names of code units (programs, modules, methods, functions, etc.) can vary for the same reasons and can be arbitrary.

At block 602, the RPM oscillation controller receives updated engine speed data. For each data update, the RPM oscillation controller operates on new and previously received or stored engine speed data, including operating upon a rolling time window in some instances. As new engine speed data arrives, older data drops out of the rolling time window so that a backward-looking rolling time window remains constant in length. The engine speed data can be transmitted or pulled from the one or more pumping units, continuously or in batches. The engine speed data can comprise engine speed data in RPM or any other appropriate engine speed or performance metric. The RPM oscillation controller engine speed data can receive the engine speed data asynchronously, where the RPM oscillation controller and the engine speed data or engine speed data generator operate at different clock speed or different frequencies, including variable clock speeds. The RPM oscillation controller can write or store the received engine speed data to one or more storage location, or can read the engine speed data from one or more storage locations. The RPM oscillation controller operates iteratively as engine speed data is received.

At block 604, the RPM oscillation controller determines if a fault is detected. The RPM oscillation controller can detect a fault, such as an interruption in engine speed data, can receive a fault warning from the engine or pumping unit or in the data transmitted by engine or pumping unit, such as RPM=0 or "FAULT", or can receive a fault notification from any other part of the wellbore operation equipment. If a fault is detected, flow continues to block 606. If a fault is not detected, flow continues to block 608. The RPM oscillation controller can detect a fault at other points in the flow or asynchronously, in which case fault detection can trigger flow to block 604 or 606.

At block 606, the RPM oscillation controller logs a fault. Any detected or determined fault can be logged, or a subset of faults relevant to engine speed or oscillation data or control.

At block 610, the RPM oscillation controller determines an engine speed variability for a rolling time window based on the corresponding engine speed data. The engine speed variability can be a bandwidth, where a bandwidth can be calculated as a difference between a maximum engine speed and a minimum engine speed recorded over the rolling time window, such as via Eq. 1, or can instead be any other measure of variability as previously described. The rolling time window can be pre-determined, operator selected, and may comprise multiple rolling time windows for bandwidth calculation where each rolling time window is of different duration.

At block 610, the RPM oscillation controller determines if the engine speed variability exceeds an RPM oscillation bandwidth threshold. The RPM oscillation controller compares the engine speed variability, which can be an RPM bandwidth, over the rolling time window determined at block 608 to a predetermined or preselected threshold—the RPM oscillation bandwidth threshold. If the engine speed bandwidth is larger than the RPM oscillation bandwidth threshold, the RPM oscillation controller determines that oscillation or erratic behavior is detected in engine or pumping unit speed and flow continues to block 614. If the engine speed bandwidth is smaller than the RPM oscillation bandwidth threshold, the RPM oscillation controller determines that oscillation or erratic behavior is not detected and flow continues to block 620.

At block 620, the RPM oscillation controller stops the variability timer, if running, and clears variability warnings, if any exist or have been issued. The RPM oscillation controller can issue a command to the variability timer to stop and clear or can clear the variability timer directly. The variability timer can be reset or otherwise ended. From block 620, flow continues to block 602 where the RPM oscillation controller operates iteratively any other engine speed data update.

At block 614, the RPM oscillation controller optionally determines if the variability is due to gear or rate change within the rolling time window. If the RPM oscillation controller identifies that a gear change or rate change (such as a rate change corresponding to a change in fluid flow rate, fluid flow pressure, valve position, etc.) has occurred, the RPM oscillation controller can determine that engine speed variability is due to the identified change in wellbore operations. The RPM oscillation controller can identify a gear change or rate change at any point over the rolling time window, or can use a different time period (such as a shorter rolling window or a time window centered on the time when the gear or rate change occurred). If the RPM oscillation controller determines that engine speed variability is due to the identified change in wellbore operations (e.g., gear change, rate change, etc.), flow continues to block 620. If the RPM oscillation controller determines that engine speed variability is not due to an identified change in wellbore operations, flow continues to block 616.

Optionally, the RPM oscillation controller can determine that the engine speed variability is due to the identified change in wellbore operation and also begin a variability timer at block 616 (as represented by the dotted "YES" line between blocks 614 and 616). In such a way, the RPM oscillation controller can further monitor erratic or oscillatory behavior due to wellbore operation changes and optionally control for variability induced by such changes.

At block 616, the RPM oscillation controller determines if a variability timer is running. The variability timer can run asynchronously from the engine speed variability determination of block 608 or the engine speed data update of block 602. The variability timer can operate on a relative time length scale, such as $t_0+\Delta t$, or can operate on an absolute time scale, such as National Institute of Science and Technology (NIST) official time in any appropriate time zone. The RPM oscillation controller can determine if the variability time is running by querying the variability timer, which can operate in another unit of software or code. The variability timer can operate within the RPM oscillation controller, such that the RPM oscillation controller controls the variability timer and as such can determine the variability timer status directly. If the RPM oscillation controller determines that the variability timer is not running, flow continues to block 618. If the RPM oscillation controller determines that the variability timer is running, flow continues to block 602 where the RPM oscillation controller operates iteratively any other engine speed data update. Further operation of the variability timer is described in reference to FIG. 7.

At block 618, the RPM oscillation controller starts a variability timer. The variability timer can measure or count forward in time from when the RPM oscillation controller first detects that the engine speed bandwidth exceeds the RPM oscillation bandwidth threshold and stop or end at another time, such as when the engine speed bandwidth no longer exceeds the oscillation bandwidth threshold. The variability timer can also determine a forward time window, running from when the engine speed bandwidth exceeds the RPM oscillation bandwidth threshold to a second time—i.e., an oscillation warning time threshold, an oscillation mitigation time threshold, etc.—and then compare values of the engine speed bandwidth included in the forward time window to the RPM oscillation threshold in order to determine if the engine speed bandwidth exceeds the RPM oscillation threshold for all times in the forward time window. The RPM oscillation controller can operate multiple variability timers concurrently, operate multiple variability timers sequentially, or clear and reuse one variability timer. The RPM oscillation controller starts a variability timer, where the variability timer operation is described in the flowchart of FIG. 7. From block 618, flow continues to block 602 where the RPM oscillation controller operates iteratively for any other engine speed data update.

Figure 7:
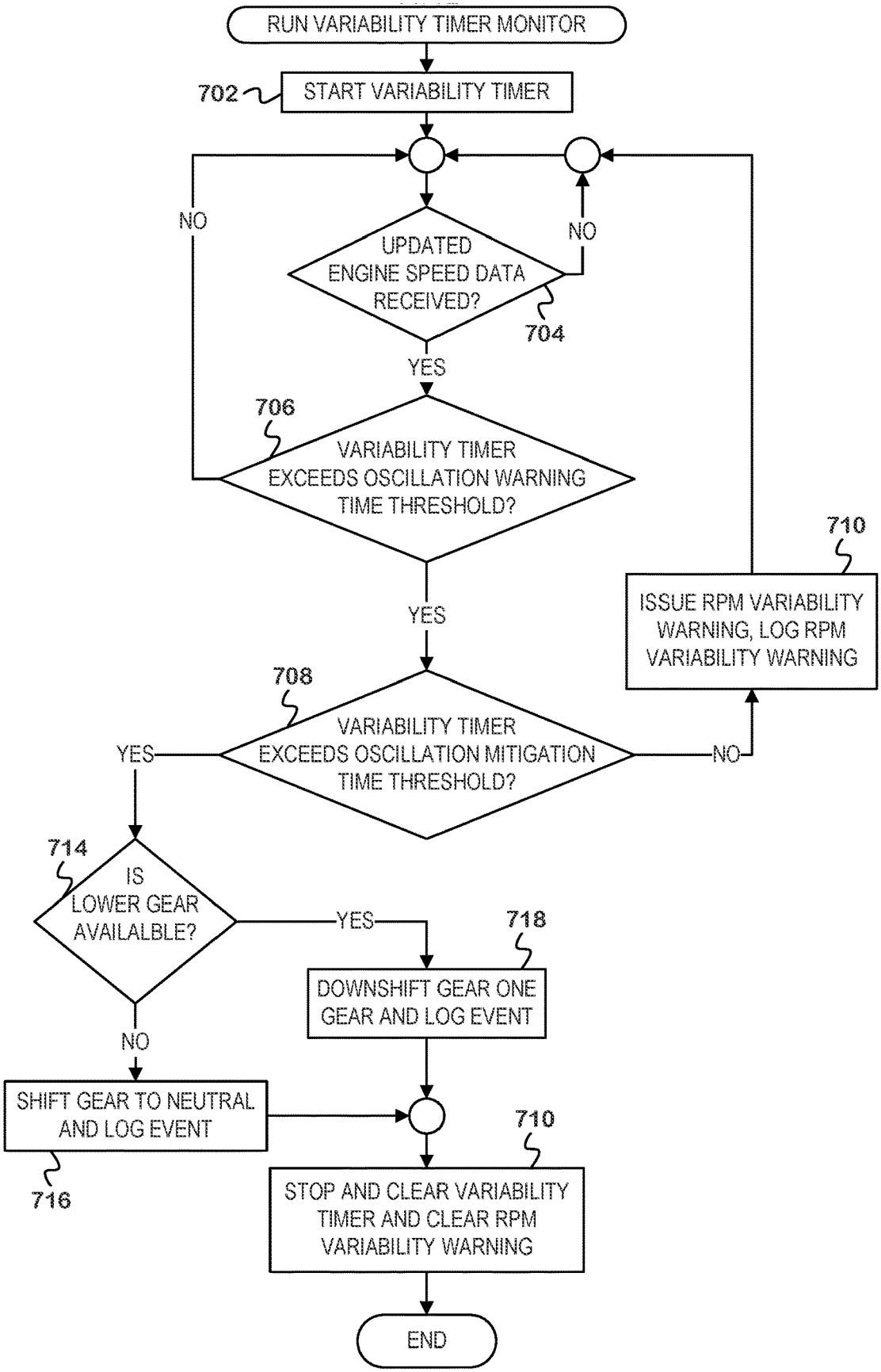
FIG. 7 is a flowchart of example operations for running a variability timer for monitoring and mitigating pumping unit engine speed oscillations.

FIG. 7 is a flowchart of example operations for running a variability timer for monitoring and mitigating pumping unit engine speed oscillations. For simplicity, the RPM oscillation detector 160 and the automatic RPM oscillation mitigator 170 are collectively referred to as the RPM oscillation controller 150, where example operations described as performed by the RPM oscillation controller 150 can be performed by either or both of the RPM oscillation detector 160 and the automatic RPM oscillation mitigator 170 or another portion of the RPM oscillation controller 150. The name chosen for the program code is not to be limiting on the claims. Structure and organization of a program can vary due to platform, programmer/architect preferences, programming language, etc. In addition, names of code units (programs, modules, methods, functions, etc.) can vary for the same reasons and can be arbitrary.

At block 702, the RPM oscillation controller starts a variability timer. The variability timer can be triggered by any appropriate actions, such as those described in the flowchart of FIG. 6. The RPM oscillation controller starts a variability timer to measure the duration of detected oscillatory or erratic engine speed behavior, and to compare the duration of such behavior to various benchmarks or time thresholds in order to indicate detected variability, and mitigate variability. The RPM oscillation controller can start the variability timer at block 618 of FIG. 6. The RPM oscillation controller can end the variability timer by any appropriate actions, such as at block 620 of FIG. 6 based on a determination that the engine speed variability does not exceed the RPM oscillation bandwidth threshold at block 610.

At block 704, the RPM oscillation controller determines if updated engine speed data has been received. If no updated engine speed data has been received, flow continues to block 704 until such time as updated engine speed data is received. If updated engine speed data has been received, flow continues to block 706. The variability timer continues to advance as long as it has not been stopped or cleared, which may be asynchronously from engine speed data updates.

At block 706, the RPM oscillation controller determines if the variability timer exceeds or reaches the oscillation warning time threshold. The oscillation warning time threshold can be predetermined or preselected by a wellbore operation operator or controller. Multiple oscillation warning times can be selected for one or more rolling time window or one or more engine speed bandwidth, including for multiple variability timers. Sequential oscillation warning time thresholds can be used, such that the RPM oscillation controller triggers more than one variability warning (e.g., a variability warning once a minute for as long as the variability persists) including subsequent variability warnings that increase in severity (e.g., first warning is a warning light, second warning is a warning light and a pop-up window, third warning is a warning light, a pop-up window, and an alarm, etc.).

The RPM oscillation controller compares the value or duration of the variability timer to the one or more oscillation warning time threshold. If the RPM oscillation controller determines that value of the variability timer exceeds the oscillation warning time threshold, flow continues to block 708. If the RPM oscillation controller determines that the value of the variability timer does not exceed the oscillation warning time threshold, flow continues to block 704.

At block 708, the RPM oscillation controller compares the value or duration of the variability timer to the oscillation mitigation time threshold. The oscillation mitigation time threshold can be predetermined or preselected by a wellbore operation operator or controller. The oscillation mitigation time threshold can be a multiple of or additive time amount in addition to the oscillation warning time threshold. Multiple oscillation mitigation times can be selected for multiple RPM oscillation thresholds. I.e., an oscillation mitigation time of one minute (60 sec) can be used over a rolling time window with an RPM oscillation threshold of 400 RPM (which in this example could be a threshold that corresponds to significant engine or pumping unit distress) while an oscillation mitigation time of five minutes (300 sec) can be used over the same or a different rolling window with an RPM oscillation threshold of 50 RPM.

The RPM oscillation controller compares the variability timer to the one or more oscillation mitigation time threshold. If the RPM oscillation controller determines that the value of the variability timer exceeds the oscillation mitigation time threshold, flow continues to block 714. If the RPM oscillation controller determines that the value of the variability timer does not exceed the oscillation mitigation time threshold, flow continues to block 710.

At block 710, the RPM oscillation controller issues and logs an RPM variability warning. The RPM variability warning can be any alert or warning to the wellbore operation operator or controller, such as those previously described in reference to FIG. 5. The RPM oscillation controller can log the RPM variability warning in any data file, including a dedicated file for warnings and errors, the log used to log faults as described at block 606, etc., or can add any instances of RPM variability warnings to the engine speed or pumping unit gear value data—as a separate entry, as a data tag, etc. Optionally, the RPM oscillation controller can log the first instance of an RPM variability warning and ignore or note duration for subsequent RPM variability warnings for each oscillation warning time threshold. The RPM oscillation controller can log RPM variability warnings in any data file, including a dedicated file for warnings and errors, the log used to log faults as described at block 606, etc., or can add RPM variability warnings to the engine speed or pumping unit gear value data—as a separate entry, as a data tag, etc.

At block 714, the RPM oscillation controller determines if a lower gear is available. The RPM oscillation controller can determine the gear of the engine or pumping unit by querying the pumping unit or pump motor, or from data received from the pumping unit or engine. The RPM oscillation controller can optionally determine the current gear value for a pumping unit or engine by tracking gear shifts and integrating over time to determine the present gear of the pumping unit or engine. The RPM oscillation controller determines if the pumping unit is currently in its lowest gear or if another lower gear exists or is available.

For pumping units which have one or more reverse gears (e.g., hydraulic pumps, pumping units containing hydraulic pumps, etc.) the RPM oscillation controller determines if a gear that is lower in magnitude is available. That is, a pumping unit with two reverse gears has a lower gear available when in the higher reverse gear (e.g., 2R is a higher gear that is larger in magnitude than 1R). A pumping unit with one reverse gear and one forward gear has no lower gear when either in first gear (i.e., gear 1) or when in reverse (i.e., gear −1). A reverse gear is not a lower gear for any forward gear in usual operation—lower gears are gears which are lower in magnitude without reversing fluid flow or operation of the pumping unit.

If the RPM oscillation controller determines that a lower gear is available, flow continues to block 718. If the RPM oscillation controller determines that a lower gear is not available, flow continues to block 716.

At block 716, the RPM oscillation controller shifts the gear to neutral and logs the event. The RPM oscillation controller can shift the pumping unit gear directly by transmitting commands to the pumping unit or can transmit commands to a pumping unit, engine, or fluid controller. The RPM oscillation controller can log the gear shift to neutral in any data file, including a dedicated file for warnings and errors, the log used to log faults as described at block 710, etc., or can add neutral shifts to the engine speed or pumping unit gear value data—as a separate entry, as a data tag, etc. The RPM oscillation controller can also issue a further warning to the wellbore operations operator or controller, such as "PUMP OFFLINE", "PUMPING UNIT OFFLINE", or other notification or emergency warning.

At block 718, the RPM oscillation controller downshifts the gear one gear and logs the event. The RPM oscillation controller downshifts the gear of the pumping unit to the next available lower gear, i.e., one gear. In some cases, due to gear naming conventions or pump or pumping unit construction, the next lower gear may not be numbered with the next lowest integer.

The RPM oscillation controller can downshift the pumping unit gear directly by transmitting commands to the pumping unit or can transmit commands to a pumping unit, engine, or fluid controller. The RPM oscillation controller can log the gear downshift in any data file or log, including those previously described. The RPM oscillation controller can also issue a further warning to the wellbore operations operator or controller, such as "PUMP DOWNSHIFT", "PUMPING UNIT DOWNSHIFT", or other notification or warning.

At block 710, the RPM oscillation controller stops and clears the variability timer and clears the RPM variability warning. The RPM variability warning, which can be a light, alert, status, pop-up window, etc.) can be deleted from wellbore operation operator or controller's display, screen, or input. Optionally, the variability warning can instead be cleared once the engine speed bandwidth no longer exceeds RPM oscillation threshold after a gear shift—instead of being cleared by the gear shift. In this case, a variability timer can continue over the gear shift or an additional variability timer for the gear shift can be operation. The RPM oscillation controller stops and clears the variability timer. The variability timer can be cleared and reset or otherwise ended.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 604 and 620 can be performed in parallel or concurrently. With respect to FIG. 6, a determination that the variability is due to gear or rate change is not necessary. Dashed lines represent functions and operations which can be asynchronous. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Figure 8:
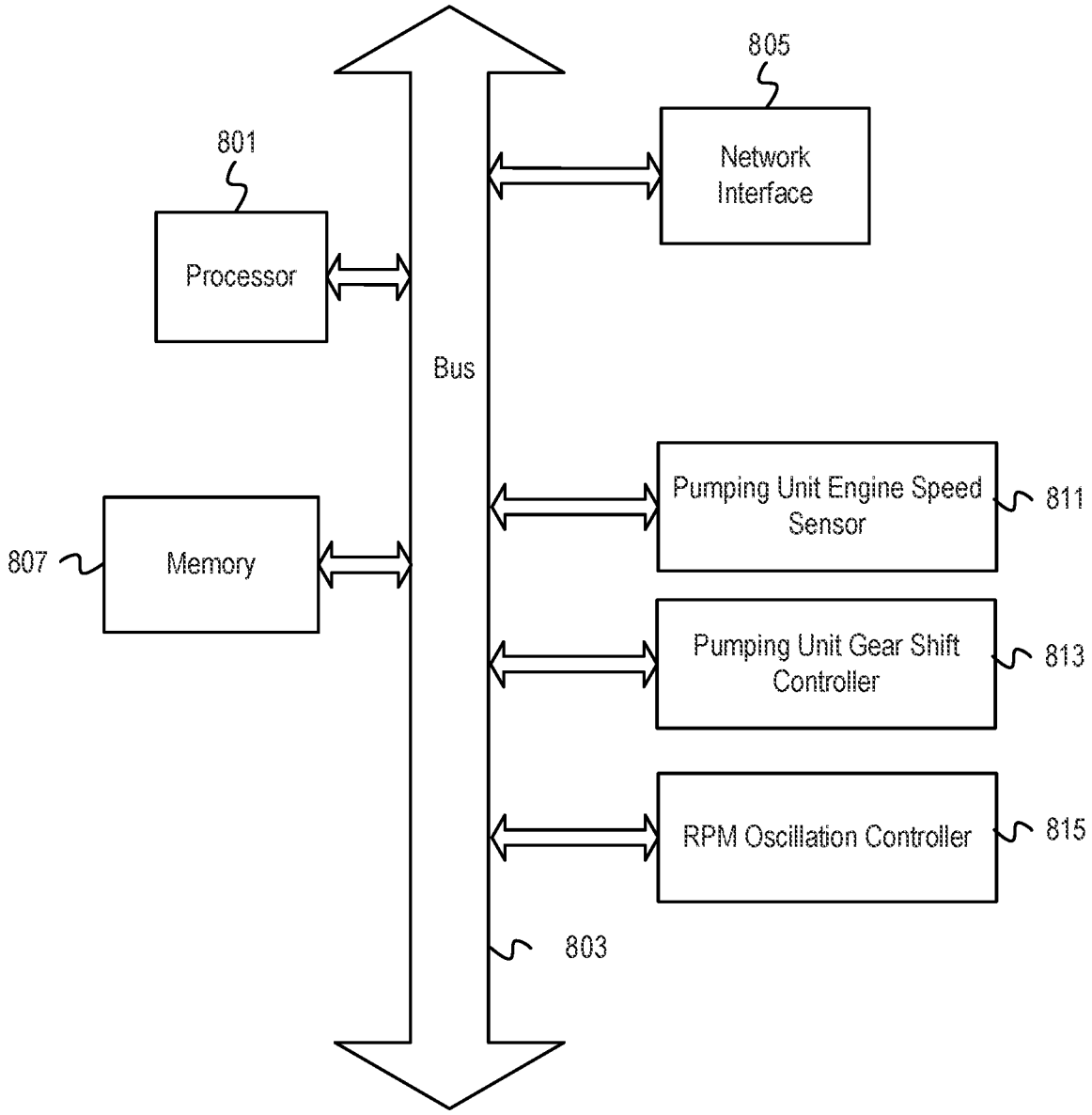
FIG. 8 depicts an example computer system for pumping unit engine speed oscillation detection and mitigation.

FIG. 8 depicts an example computer system for RPM oscillation control. The computer system includes a processor 801 (possibly including multiple processors, multiple cores, multiple nodes, and/or implementing multi-threading, etc.). The computer system includes memory 807. The memory 807 may be system memory or any one or more of the above already described possible realizations of machine-readable media. The computer system also includes a bus 803 and a network interface 805. The system also includes a pumping unit engine speed sensor 811, a pumping unit gear shift controller 813, and an RPM oscillation controller 815. The pumping unit engine speed sensor 811 detects or measures the engine speed of a pumping unit or other fluid flow engine, which may be in RPM or other units of measure. The pumping unit gear shift controller 813 controls or outputs commands for gear shifting to the pumping unit from the RPM oscillation controller 815. The RPM oscillation controller 815 operates on data, including that obtained by the pumping unit engine speed sensor 811 to control RPM oscillation and mitigate RPM oscillation or other erratic engine speed behavior for one or more pumping units. The pumping unit engine speed sensor 811 and the pumping unit gear shift controller 813 may be part of the pump, pumping unit, or engine or may be in communication with the pumping unit or engine. The RPM oscillation controller 815 may be part of a larger wellbore operation controller or distributed across multiple locations or control systems. Any one of the previously described functionalities may be partially (or entirely) implemented in hardware and/or on the processor 801. For example, the functionality may be implemented with an application specific integrated circuit, in logic implemented in the processor 801, in a co-processor on a peripheral device or card, etc. Further, realizations may include fewer or additional components not illustrated in FIG. 8 (e.g., video cards, audio cards, additional network interfaces, peripheral devices, etc.). The processor 801 and the network interface 805 are coupled to the bus 803. Although illustrated as being coupled to the bus 803, the memory 807 may be coupled to the processor 801.

While the aspects of the disclosure are described with reference to various implementations and exploitations, it will be understood that these aspects are illustrative and that the scope of the claims is not limited to them. In general, techniques for RPM oscillation control as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Terminology

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A method for execution by one or more processors communicatively coupled to a non-transitory computer-readable media, the method comprising:

determining a first measure of engine speed variability over a first time period based, at least in part, on engine speed data associated with one or more pumping units of a wellbore operation, wherein each of the one or more pumping units includes a transmission that operates at one or more gear settings;

comparing the first measure of engine speed variability to an oscillation bandwidth threshold;

detecting erratic behavior in engine speed corresponding to the first time period based, at least in part, on a determination that the first measure of engine speed variability exceeds the oscillation bandwidth threshold over the first time period; and in response to detecting the erratic behavior in engine speed over the first time period, initiating a timer for a second time period greater than the first time period;

determining whether the erratic behavior continues through both the first time period and the second time period; and in response to determining that the erratic behavior continues through both the first time period and the second time period, mitigating engine speed oscillation, wherein mitigating engine speed oscillation includes:

determining whether a current gear setting of the one or more gear settings is a lowest gear setting;

in response to determining that the current gear setting is not the lowest gear setting, shifting the current gear setting to a lower gear setting; and in response to determining that the current gear setting is the lowest gear setting, shifting the current gear setting to neutral.

2. The method of claim 1, wherein in response to detecting the erratic behavior in engine speed over the first time period, performing at least one of generating a first warning and logging the detected erratic behavior as an event.

3. The method of claim 2, wherein mitigating the engine speed oscillation based, at least partly, on detecting the erratic behavior comprises:

generating a warning for the one or more pumping units.

4. The method of claim 1, wherein determining the first measure of engine speed variability comprises determining at least one of a bandwidth of engine speed, a variance of engine speed, and a standard deviation of engine speed.

5. The method of claim 1, wherein engine speed data comprises rotations per minute (RPM) data.

6. The method of claim 1, wherein the first time period includes one or more rolling time windows and determining whether the erratic behavior continues across the first time period comprises:

determining a measure of engine speed variability in each instance of each rolling time window; and comparing each measure of engine speed variability to the oscillation bandwidth threshold to detect erratic behavior within the corresponding instance of the rolling time window, wherein comparing each measure of engine speed variability includes comparing the first measure of engine speed variability to the oscillation bandwidth threshold.

7. The method of claim 1, further comprising determining whether a change in rate of engine speed or gear ratio of a transmission occurred within the first time period, wherein detecting the erratic behavior is also based on a determination that a change in the rate of engine speed or the gear ratio of the transmission did not occur within the first time period.

8. A non-transitory, machine-readable medium having instructions stored thereon that are executable by a computing device, the instructions comprising instructions to:

determine a first measure of engine speed variability over a first time period based, at least in part, on engine speed data associated with one or more pumping units of a wellbore operation, wherein each of the one or more pumping units includes a transmission that operates at one or more gear settings;

compare the first measure of engine speed variability to an oscillation bandwidth threshold;

determine that erratic behavior in engine speed is detected if the first measure of engine speed variability exceeds the oscillation bandwidth threshold over the first time period;

in response to detecting the erratic behavior in engine speed over the first time period, initiate a timer for a second time period greater than the first time period;

determine whether the erratic behavior continues through both the first time period and the second time period; and in response to determining that the erratic behavior continues through both the first time period and the second time period, mitigate engine speed oscillation, wherein mitigating engine speed oscillation includes:

determining whether a current gear setting of the one or more gear settings is a lowest gear setting;

in response to determining that the current gear setting is not the lowest gear setting, shifting the current gear setting to a lower gear setting; and in response to determining that the current gear setting is the lowest gear setting, shifting the current gear setting to neutral.

9. The non-transitory, machine-readable medium of claim 8, wherein the instructions comprise instructions to:

in response to detecting the erratic behavior in engine speed over the first time period, perform at least one of generate a first warning and log the detected erratic behavior as an event.

10. An apparatus comprising:

a processor; and a computer-readable medium having instructions stored thereon that are executable by the processor to cause the apparatus to, determine a first measure of engine speed variability over a first time period based, at least in part, on engine speed data associated with one or more pumping units of a wellbore operation, wherein each of the one or more pumping units operates at one or more gear settings;

compare the first measure of variability to an oscillation bandwidth threshold;

determine that erratic behavior in engine speed is detected when the first measure of engine speed variability exceeds the oscillation bandwidth threshold over the first time period; in response to detecting the erratic behavior in engine speed over the first time period, initiate a timer for a second time period greater than the first time period;

determine whether the erratic behavior continues through both the first time period and the second time period; and in response to determining that the erratic behavior in engine speed continues through both the first time period and the second time period, mitigate engine speed oscillation, wherein mitigating engine speed oscillation includes:

determining whether a current gear setting of the one or more gear settings is a lowest gear setting;

in response to determining that the current gear setting is not the lowest gear setting, shifting the current gear setting to a lower gear setting; and in response to determining that the current gear setting is the lowest gear setting, shifting the current gear setting to neutral.

11. The apparatus of claim 10, further comprising instructions to:

based on a determination that the erratic behavior has exceeded the first time period, generate a warning for the one or more pumping units; and wherein the instructions to indicate detected erratic behavior comprise instructions to log the detected erratic behavior as an event.

* * * * *